US008001739B1

(12) United States Patent
Inzeo et al.

(10) Patent No.: US 8,001,739 B1
(45) Date of Patent: Aug. 23, 2011

(54) PARAPET WALL COVER SYSTEM

(75) Inventors: Joseph A. Inzeo, West Allis, WI (US); Scott A. Kittilstad, Waukesha, WI (US)

(73) Assignee: Metal-Era, Inc., Waukesha, WI (US)

( * ) Notice: Subject to any disclaimer, the term of this patent is extended or adjusted under 35 U.S.C. 154(b) by 296 days.

(21) Appl. No.: 12/269,178

(22) Filed: Nov. 12, 2008

Related U.S. Application Data

(60) Provisional application No. 60/987,445, filed on Nov. 13, 2007.

(51) Int. Cl.
*E04H 12/00* (2006.01)

(52) U.S. Cl. ..... 52/300; 52/198; 52/60

(58) Field of Classification Search ..... 52/3, 198, 52/300, 465, 58, 60, 94, 96, 219
See application file for complete search history.

(56) References Cited

U.S. PATENT DOCUMENTS 3,802,140 A 4/1974 Hickman
3,862,531 A 1/1975 Attaway et al.
3,992,827 A * 11/1976 Johnson ..... 52/60
4,083,158 A * 4/1978 Wolma ..... 52/300
5,718,086 A * 2/1998 Dunn ..... 52/95
5,893,247 A * 4/1999 Hickman et al. ..... 52/300
6,378,256 B1 4/2002 Gembala
2005/0028464 A1* 2/2005 Kay et al. ..... 52/300
2005/0235578 A1* 10/2005 Heidler, Jr. ..... 52/58
2005/0257443 A1* 11/2005 Lin ..... 52/97

* cited by examiner

*Primary Examiner* — Eileen D Lillis
*Assistant Examiner* — Branon Painter
(74) *Attorney, Agent, or Firm* — Donald J. Ersler

(57) ABSTRACT

A parapet wall cover system includes a clip support, at least one spring support clip and a cover channel. The at least one spring support clip is attached to a top of the clip support channel. The cover channel includes a top surface, a first side surface and a second side surface. The parapet cover system is preferably attached to a parapet wall in the following manner. The clip support is attached to a top of the parapet wall. The at least one spring support clip is secured to the clip support. The cover channel is pushed on to either the clip support channel or the at least one spring support clip and is retained thereby. A vented parapet cover system includes a perforated clip support. A perforated closure may be substituted for the perforated support channel.

14 Claims, 29 Drawing Sheets

PARAPET WALL COVER SYSTEM

CROSS-REFERENCES TO RELATED APPLICATIONS

This is a nonprovisional patent application taking priority from provisional application No. 60/987,445 filed on Nov. 13, 2007.

BACKGROUND OF THE INVENTION

1. Field of the Invention

The present invention relates generally to parapet walls and more specifically to a parapet wall cover system, which eliminates the need for nailer strips.

2. Discussion of the Prior Art

Wood nailer strips are subject to shrinking, splitting, warping and rotting. Further, wood nailer strips are also subject to damage from termites and carpenter ants. Treated wood nailer strips contain chemicals that are corrosive to fasteners. It would be advantageous to eliminate the need from wood nailer strips, when placing a coping over a parapet wall. An example of a parapet wall cover system that uses a wood nailer is the Perma-Tite coping sold by Metal-Era, Inc. of Waukesha, Wis.

U.S. Pat. No. 3,802,140 to Hickman discloses a coping. The Hickman patent includes protecting a top of a parapet wall with inverted U-shaped anchor elements secured to the wall at space points where the lengths of the coping units substantially abut. However, the anchor elements do not include a lengthwise support to square the anchor elements to the coping.

U.S. Pat. No. 3,862,531 to Attaway et al. discloses a coping structure. The Attaway et al. patent discloses a coping structure where a splice joint between a pair of normally inverted channel like coping members is had through use of a splice member, which cooperates inside the channels of the pair of coping members for covering a transverse seam between adjacent longitudinal ends. However, the splice joint does not include a lengthwise support to square the splice joint to the coping members.

U.S. Pat. No. 6,378,256 to Gembala discloses a wall closure for roof systems. The Gembala patent includes a wall closure having a generally M-shaped configuration to provide an anchoring flange for attachment to the top of parapet wall.

Accordingly, there is a clearly felt need in the art for a parapet wall cover system, which reduces labor costs by eliminating the need for nailer strips and which eliminates a fire hazard and the consequences of failure by the wood nailer strips or the fasteners inserted therein.

SUMMARY OF THE INVENTION

The present invention provides a parapet wall cover system, which eliminates the need for nailer strips. The parapet wall cover system (parapet cover system) includes a clip support channel, at least one spring support clip and a cover channel. The clip support channel includes a top member, a first side member and a second side member. The first side member extends downward from one end of the top member and the second side member extends downward from the other end of the top member. A bottom end of the first side member is terminated with a first offset flange. A bottom end of the second side member is terminated with a second offset flange. A length of the clip support channel is long enough to provide a flat surface for the attachment of the cover channel to the parapet wall.

The at least one spring support clip is located and attached to a top of the clip support channel. The cover channel includes a top surface, a first side surface and a second side surface. The first side surface extends downward from one end of the top surface and the second side surface extends downward from the other end of the top surface. A bottom end of the first side surface is terminated with a first attachment clip. A bottom end of the second side member is terminated with a second attachment clip.

The parapet cover system is preferably attached to a parapet wall in the following manner. The clip support channel is preferably attached to first and second sides of the parapet wall with a plurality of fasteners or the like. The at least one spring support clip is located on the clip support channel and attached to the parapet wall with a plurality of fasteners or the like. The first attachment clip of the cover channel is hooked over the first offset flange. The second attachment clip is pushed over the second offset flange and hooked thereto.

A vented parapet cover system includes a perforated clip support channel. The roof membrane does not extend over a gap in the parapet wall.

A second embodiment of a vented parapet cover system includes a clip support structure, at least one spring support clip, a cover channel and a perforated closure. The clip support structure includes a bottom channel, a top channel and a plurality of support spacers. The top channel is attached to one end of the plurality of support spacers and the bottom channel is attached to the other end of the plurality of support spacers. A length of the clip support structure is long enough to provide a flat surface for the attachment of the cover channel to the parapet wall.

The spring support clip includes a base plate, a first side member and a second side member. The first side member extends downward from one end of the base plate and the second side member extends downward from the other end of the base plate. A bottom end of the first side member is terminated with a first offset flange. A bottom end of the second side member is terminated with an angled flange.

The parapet cover system is preferably attached to a parapet wall in the following manner. The clip support structure is attached to a top of the parapet wall with a plurality of fasteners or the like. The at least one spring support clip is located on and attached to the clip support structure with a plurality of fasteners or the like. The first attachment clip of the cover channel is hooked over the first offset flange of the at least one spring support clip. The second attachment clip of the cover channel is pushed over the angled flange of the at least one spring support clip and hooked thereto.

Accordingly, it is an object of the present invention to provide a parapet wall cover system, which reduces labor costs by eliminating the need for nailer strips.

It is a further object of the present invention to provide a parapet wall cover system, which includes the option of ventilating the parapet wall.

Finally, it is another object of the present invention to provide a parapet wall cover system, which eliminates a fire hazard and the consequences of failure by the wood nailer strips or the fasteners inserted therein.

These and additional objects, advantages, features and benefits of the present invention will become apparent from the following specification.

DETAILED DESCRIPTION OF THE PREFERRED EMBODIMENTS

Figure 1:
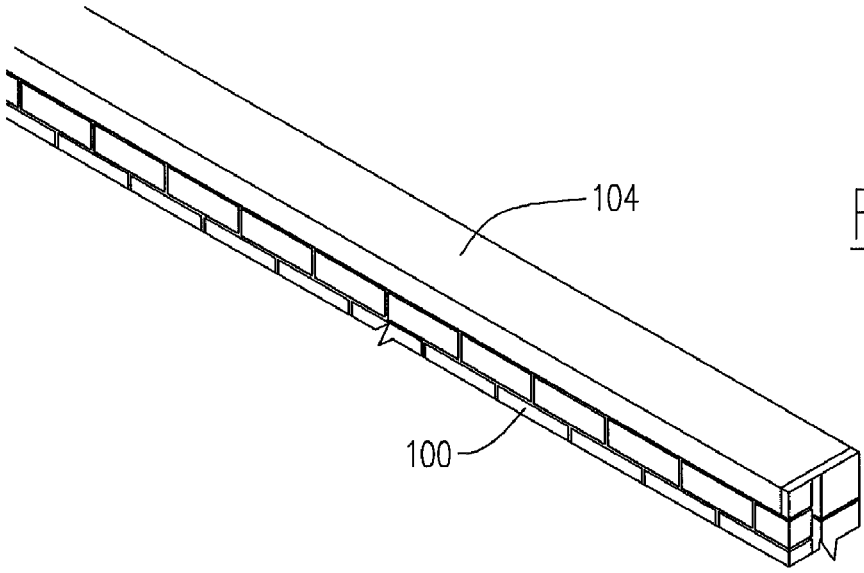
FIG. 1 is a perspective view of a parapet wall with a roof membrane laid thereover.
Figure 2:
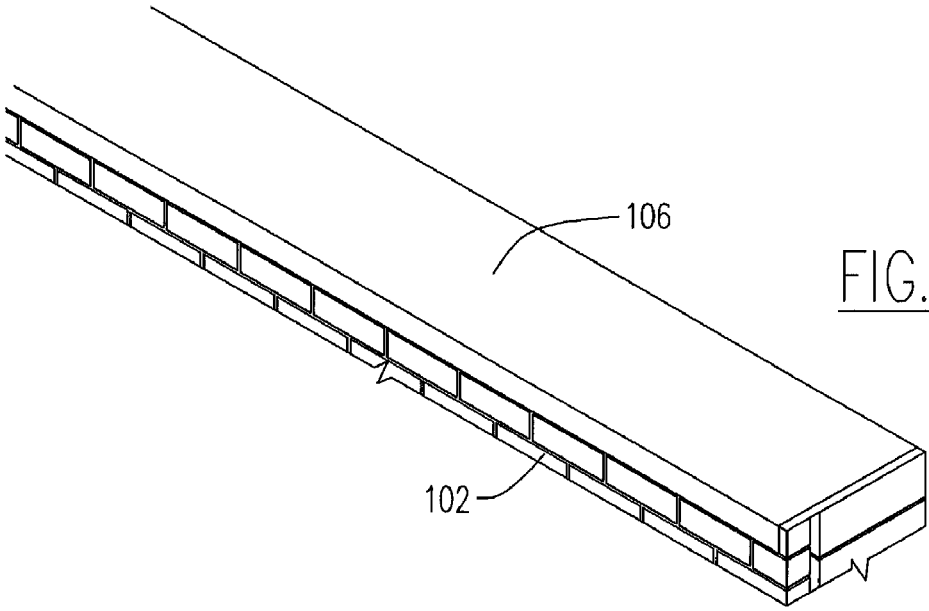
FIG. 2 is a perspective view of a wide parapet wall with a roof membrane laid thereover.
Figure 1A:
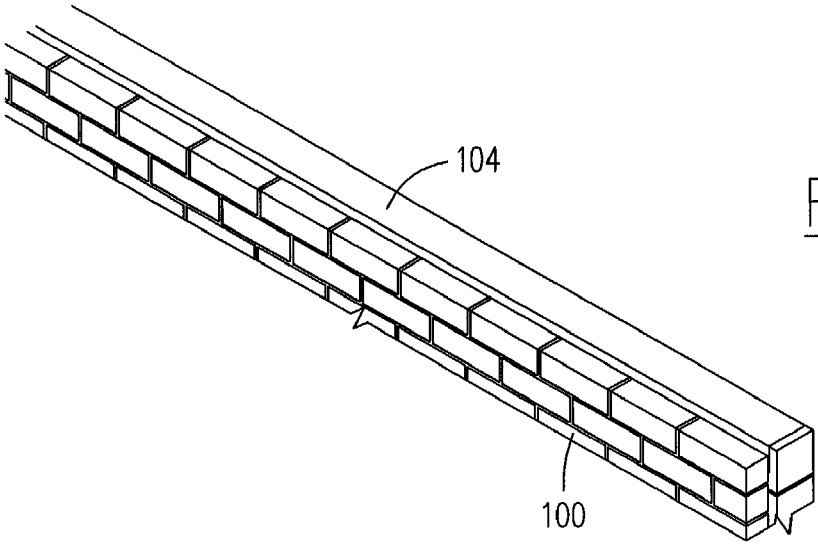
FIG. 1*a* is a perspective view of a parapet wall with a roof membrane laid partially thereover.
Figure 2A:
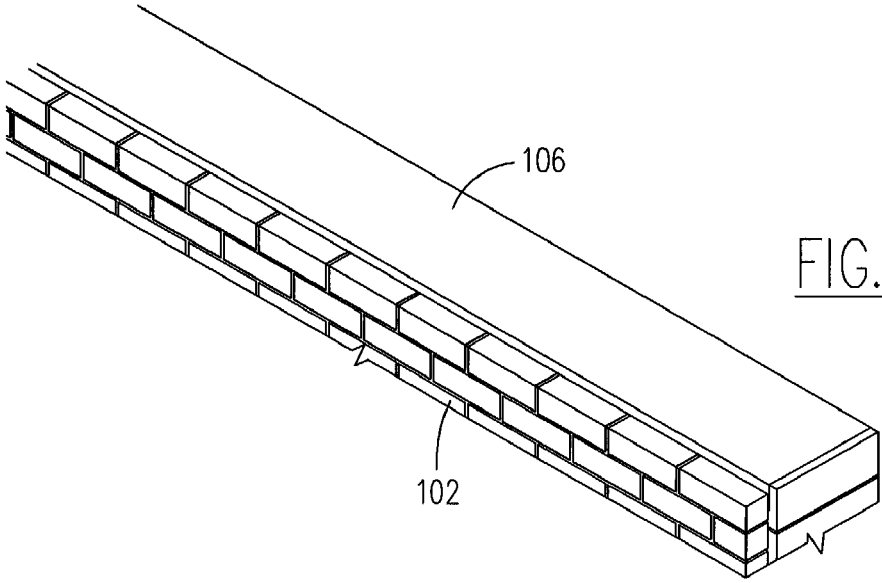
FIG. 2*a* is a perspective view of a wide parapet wall with a roof membrane laid partially thereover.
Figure 22:
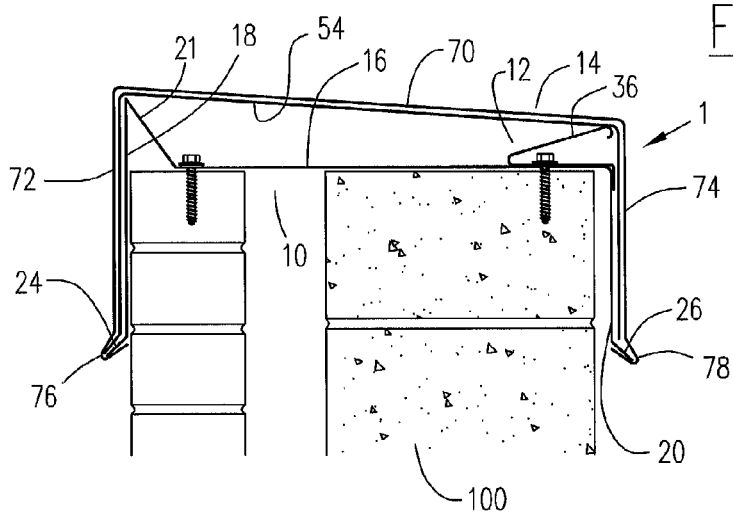
FIG. 22 is an end view of a parapet cover system in accordance with the present invention.
Figure 23:
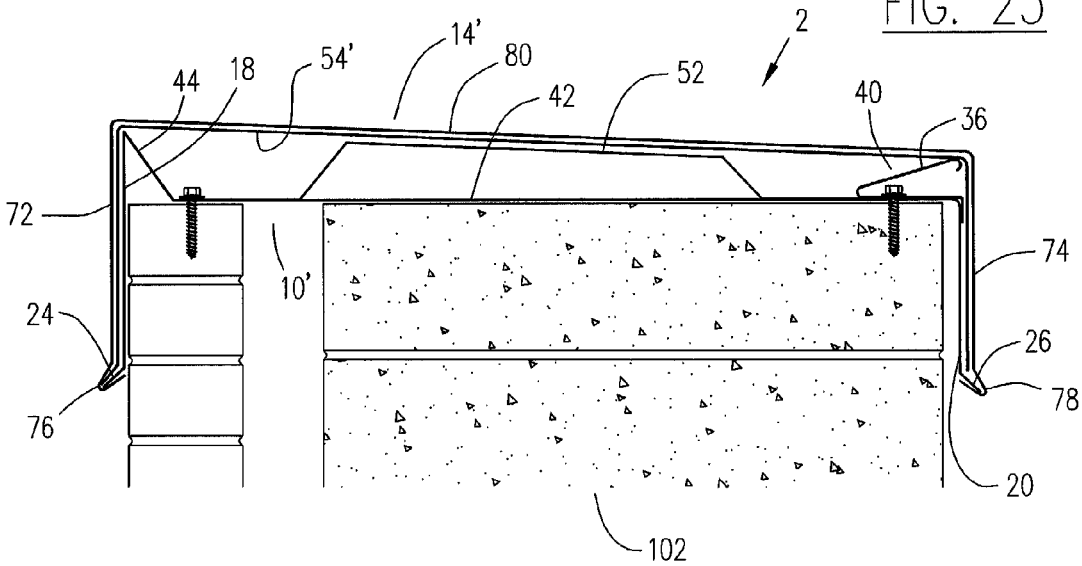
FIG. 23 is an end view of a second embodiment of a parapet cover system for a wide parapet wall in accordance with the present invention.
Figure 22A:
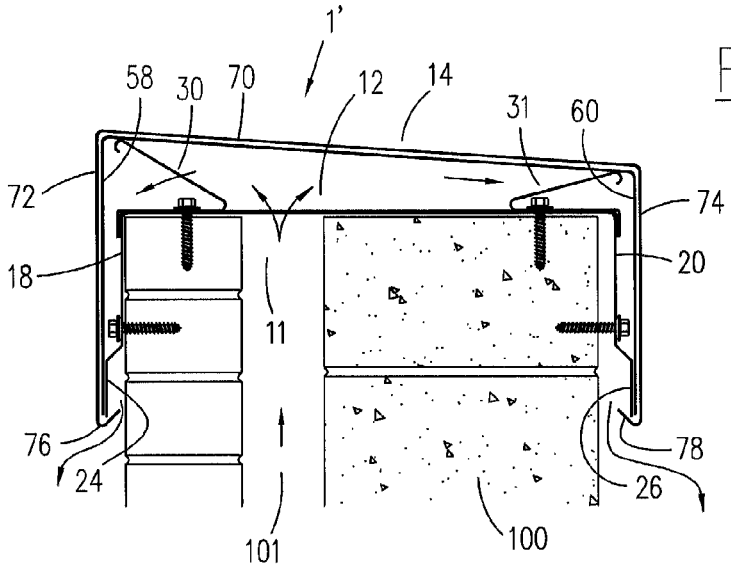
FIG. 22*a* is an end view of a vented parapet cover system in accordance with the present invention.
Figure 23A:
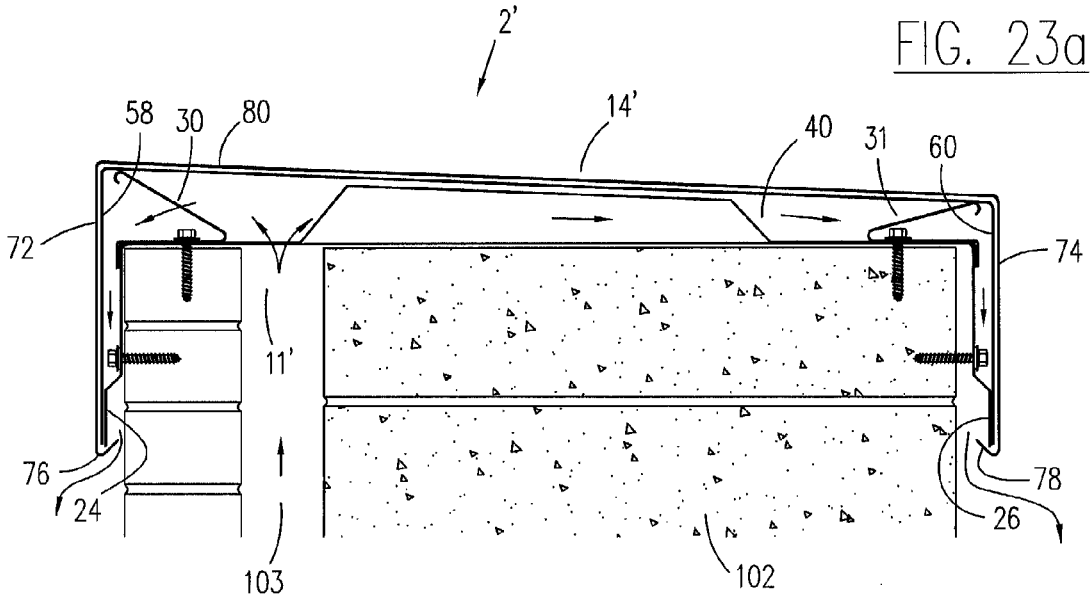
FIG. 23*a* is an end view of a second embodiment of a vented parapet cover system for a wide parapet wall in accordance with the present invention.

With reference now to the drawings, and particularly to FIG. 22, there is shown an end view of a parapet cover system 1 for a parapet wall 100. FIG. 22*a* illustrates an end view of a vented parapet cover system 1'. FIG. 23 illustrates an end view of a second embodiment of a parapet cover system 2 for a wide parapet wall 102. FIG. 23*a* illustrates an end view of a second embodiment of a vented parapet cover system 2' for a wide parapet wall 102. FIG. 1 shows a roof membrane 104 placed over a top of the parapet wall 100. With reference to FIG. 1*a*, the roof membrane 104 does not cover a parapet gap 101 in the parapet wall 100. FIG. 2 shows a roof membrane 106 placed over a top of the wide parapet wall 102. With reference to FIG. 2*a*, the roof membrane 106 does not cover a parapet gap 103 in the parapet wall 102.

Figure 3:
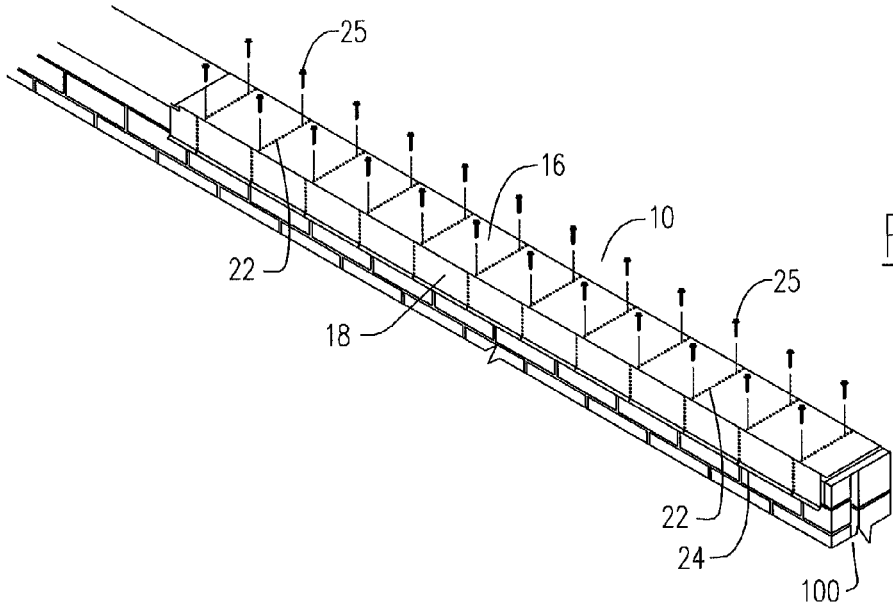
FIG. 3 is a perspective view of a parapet wall with a clip support channel, before attachment thereto of a parapet cover system in accordance with the present invention.
Figure 3A:
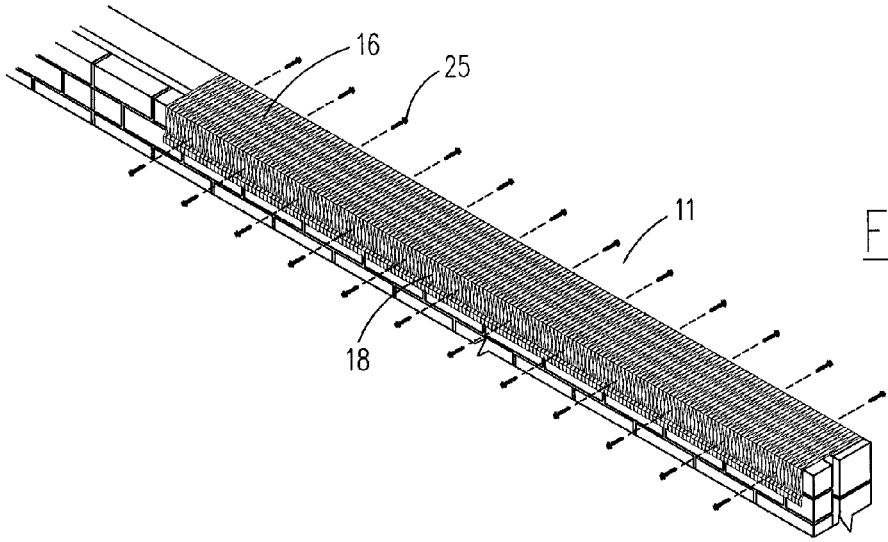
FIG. 3*a* is a perspective view of a parapet wall with a perforated clip support channel, before attachment thereto of a vented parapet cover system in accordance with the present invention.
Figure 6:
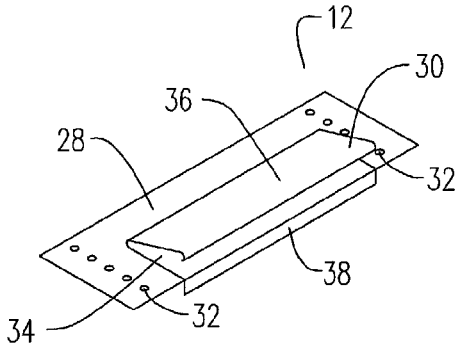
FIG. 6 is a perspective view of a spring support clip of a parapet cover system in accordance with the present invention.
Figure 8:
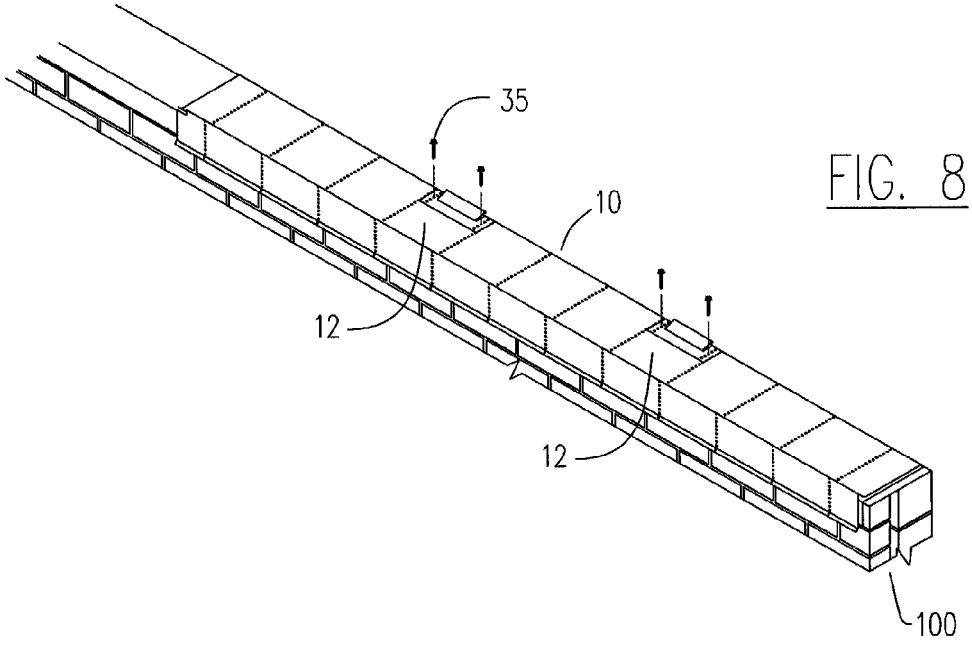
FIG. 8 is a perspective view of a spring support clip, before attachment to a parapet wall of a parapet cover system in accordance with the present invention.

With reference to FIGS. 3, 6 and 8, the parapet cover system 1 includes a clip support channel 10, at least one spring support clip 12 and a cover channel 14. The clip support channel 10 includes a top member 16, a first side member 18 and a second side member 20. The first side member 18 extends downward from one end of the top member 16 and the second side member 20 extends downward from the other end of the top member 16. With reference to FIG. 3*a*, the clip support channel 10 is perforated to form a perforated clip support channel 11. The vented parapet cover system 1' substitutes the perforated clip support channel 11 for the clip support channel 10 of the parapet cover system 1.

A bottom end of the first side member 18 is terminated with a first offset flange 24. A bottom end of the second side member 20 is terminated with a second attachment flange 26. A plurality of fastener holes 22 are formed in a line through the top member 16, the first side member 18 and the second side member 20. The line of fastener holes 22 are spaced at a set interval along a length of the clip support channel 10.

Figure 5:
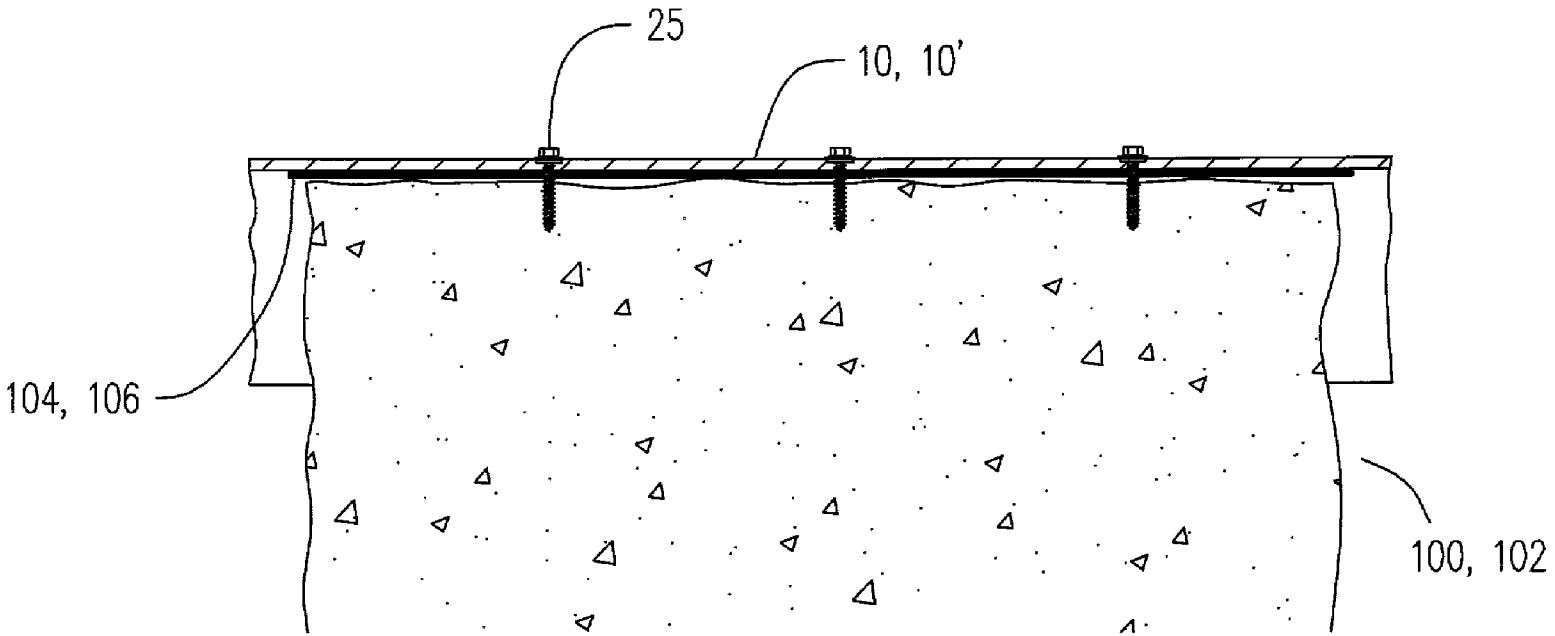
FIG. 5 is a lengthwise cross sectional view of a clip support channel attached to a parapet wall of a parapet cover system in accordance with the present invention.

With reference to FIG. 5, a preferable length of the clip support channel 10 is at least four feet or long enough to provide a flat surface for the attachment of the cover channel 14 to the parapet wall 100. A parapet wall rarely has a flat top surface, but usually has varying heights at different locations along a length thereof. The clip support channel 10 is preferably attached to the parapet wall 100 by inserting a plurality of fasteners 25 through the plurality of fastener holes 22 in a horizontal plane and securing the plurality of fasteners 25 to the parapet wall 100.

The at least one spring support clip 12 includes a base plate 28, a first spring support 30 and a second spring support 31. A first location flange 33 extends downward from one end of the base plate 28 and a second location flange 37 extends downward from the other end thereof. A distance between inner walls of the first and second location flanges are sized to receive an outer width of the clip support channel 10. A plurality of fastener holes 32 are formed through opposing sides of the base plate 28.

The first spring support 30 includes a spring base 34, a spring leg 36 and a locator leg 38. The second spring support 31 includes the spring base 34, the spring leg 36 and the locator leg 38. The spring base 34 is attached to a top of the base plate 28 with welding or any other suitable process. The spring leg 36 extends upward from one end of the spring base 34 and the locator leg 38 extends downward from the other end of the spring base 34. The spring leg 36 pivots relative to the one end of the spring base 34. The locator leg 38 is located against the first or second location flanges. The at least one spring support clip 12 is attached to the parapet wall 100 with a plurality of fasteners 35.

Figure 4:
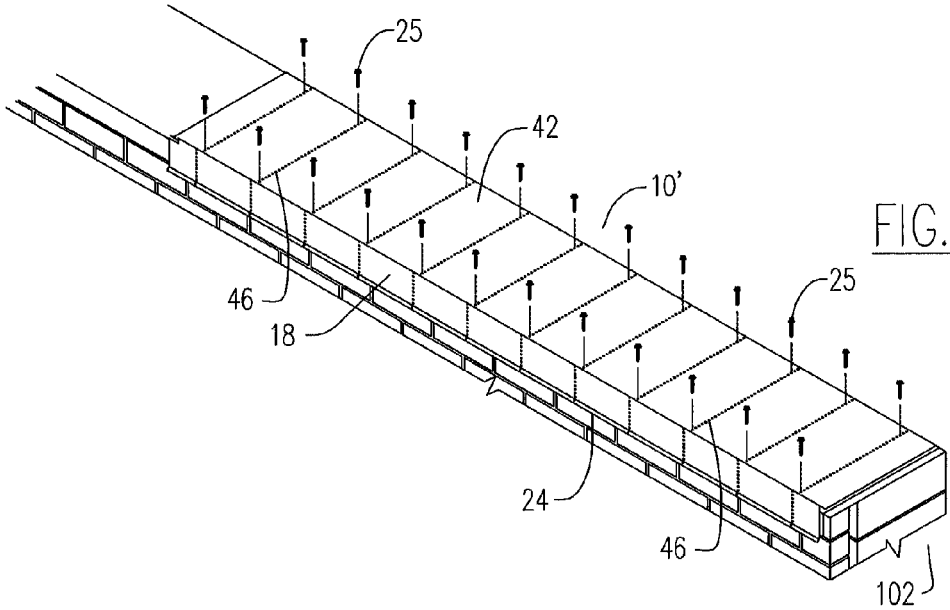
FIG. 4 is a perspective view of a wide parapet wall with a clip support channel before attachment thereto of a second embodiment of a parapet cover system in accordance with the present invention.
Figure 4A:
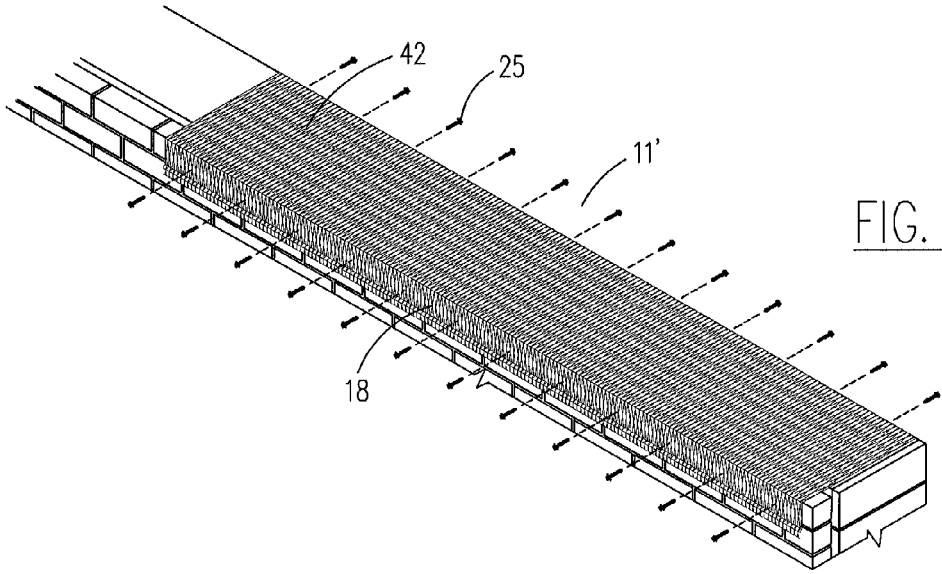
FIG. 4*a* is a perspective view of a wide parapet wall with a perforated clip support channel before attachment thereto of a second embodiment of a vented parapet cover system in accordance with the present invention.
Figure 7:
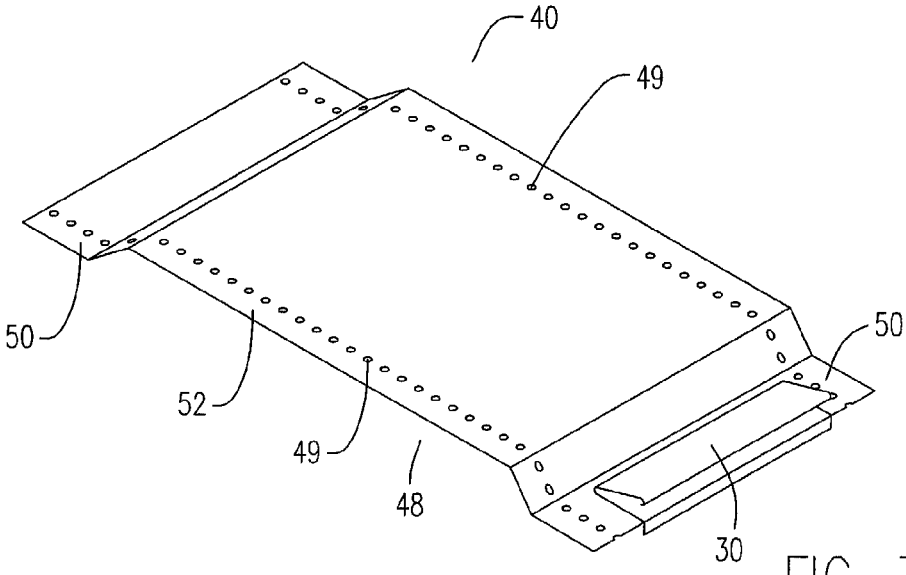
FIG. 7 is a perspective view of a spring support clip for a wide parapet wall of a second embodiment of a parapet cover system in accordance with the present invention.
Figure 9:
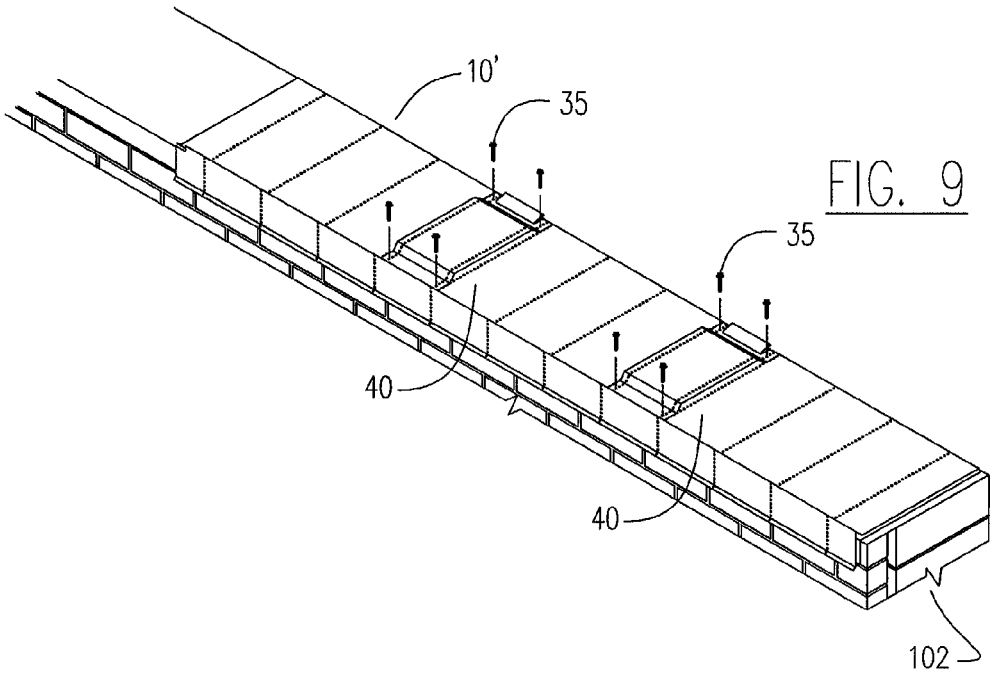
FIG. 9 is a perspective view of a spring support clip for a wide parapet wall, before attachment to a wide parapet wall of a second embodiment of a parapet cover system in accordance with the present invention.

With reference to FIGS. 4, 7 and 9, the parapet cover system 2 includes a clip support channel 10', at least one spring support clip 40 and a cover channel 14'. The clip support channel 10' includes a top member 42, the first side member 18 and the second side member 20. The first side member 18 extends downward from one end of the top member 42 and the second side member 20 extends downward from the other end of the top member 42. The bottom end of the first side member 18 is terminated with the first offset flange 24. The bottom end of the second side member 20 is terminated with the second offset flange 26. With reference to FIG. 4*a*, the clip support channel 10' is perforated to form a perforated clip support channel 11'. The vented parapet cover system 2' substitutes the perforated clip support channel 11' for the clip support channel 10' of the parapet cover system 2.

A plurality of fastener holes 46 are formed in a line through the first side member 18, the top member 42 and the second side member 20. The line of fastener holes 46 are spaced at a set interval along a length of the clip support channel 10'. With reference to FIG. 5, a preferred length of the clip support channel 10' is at least four feet or long enough to provide a flat surface for the attachment of the cover channel 14' to the parapet wall 102. A parapet wall rarely has a flat top surface, but usually has varying heights at different locations along a length thereof. The clip support channel 10' is attached to the parapet wall 102 by inserting a plurality of fasteners 25 through the plurality of fastener holes 46 in a horizontal plane and securing the plurality of fasteners 25 to the wide parapet wall 102.

The at least one spring support clip 40 includes a base plate 48, the first spring support 30 and the second spring support 31. The base plate 48 includes a base portion 50 and an offset portion 52. The offset portion 52 extends upward from the base portion 50. The offset portion 52 supports the cover channel 14'. A first location flange 53 extends downward from one end of the base plate 48 and a second location flange 55 extends downward from the other end thereof.

A distance between inner walls of the first and second location flanges are sized to receive an outer width of the clip support channel 10'. A plurality of fastener holes 49 are formed through opposing sides of the base plate 48. The spring base 34 of the first and second spring supports are attached to a top of the base portion 50 on each end with a metal lock or any other suitable process. The locator leg 38 is used to located against the first or second location flanges. The at least one spring support clip 40 is attached to the wide parapet wall 102 with a plurality of fasteners 35.

Figure 10:
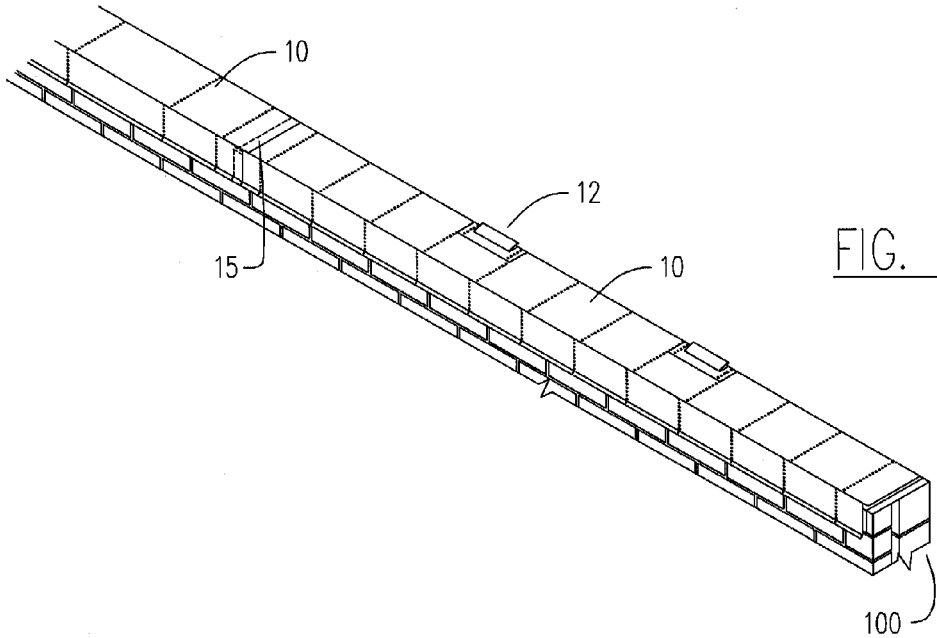
FIG. 10 is a perspective view of a second clip support channel attached to an end of a first clip support channel of a parapet cover system in accordance with the present invention.
Figure 11:
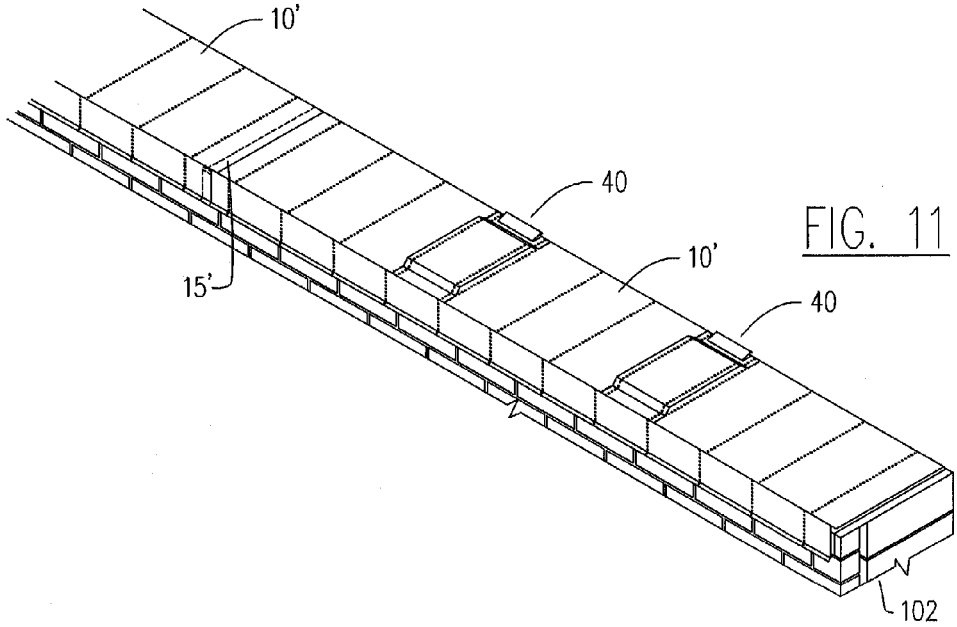
FIG. 11 is a perspective view of a second clip support channel attached to an end of a first clip support channel for a wide parapet wall of a second embodiment of a parapet cover system in accordance with the present invention.
Figure 12:
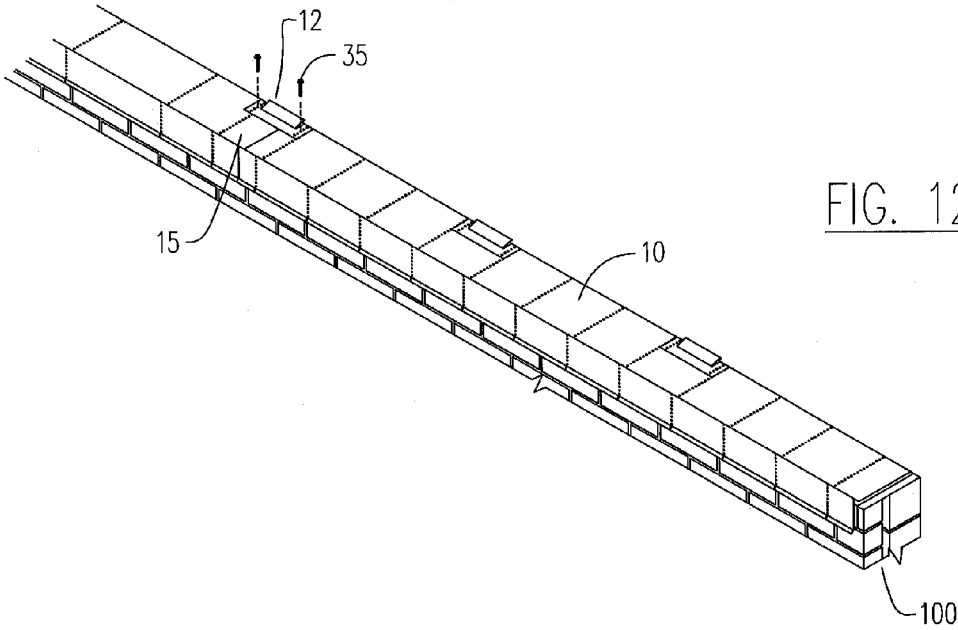
FIG. 12 is a perspective view of a spring support clip before attachment over a junction of a first and second clip support channel of a parapet cover system in accordance with the present invention.
Figure 13:
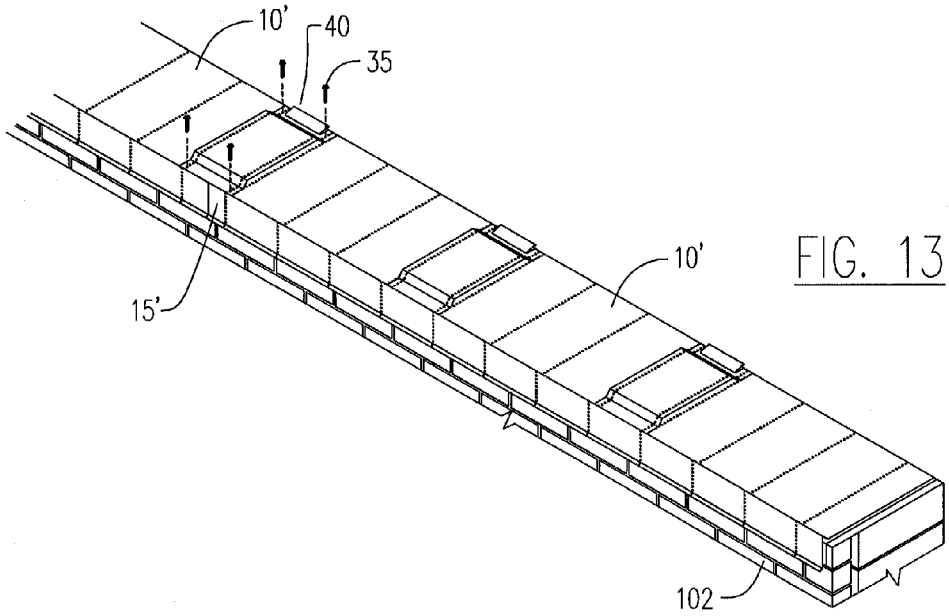
FIG. 13 is a perspective view of a spring support clip before attachment over a junction of a first and second clip support channel for a wide parapet wall of a second embodiment of a parapet cover system in accordance with the present invention.

FIG. 10 illustrates a second clip support channel 10 overlapping a first clip support channel 10 at an overlap area 15. A third spring support clip 12 is placed over the overlap area 15 and attached to the parapet wall 100 with fasteners 35 in FIG. 12. FIG. 11 illustrates a second clip support channel 10' overlapping a first clip support channel 10' at an overlap area 15'. A third spring support clip 40 is placed over the overlap area 15' and attached to the parapet wall 102 with fasteners 35 in FIG. 13.

Figure 14:
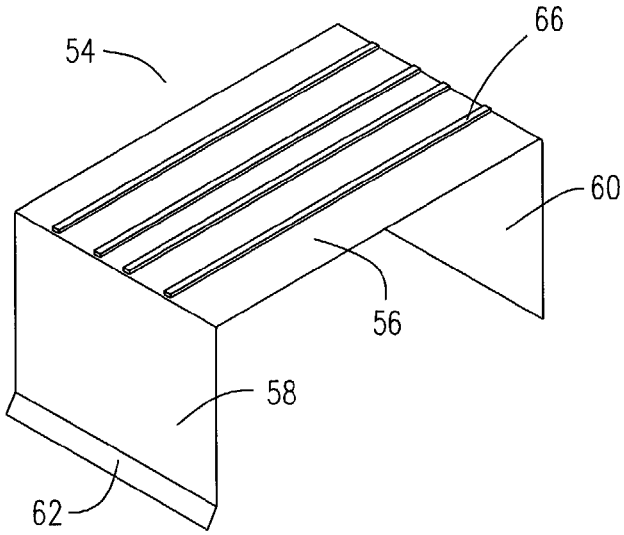
FIG. 14 is a perspective view of a splice channel of a parapet cover system in accordance with the present invention.
Figure 15:
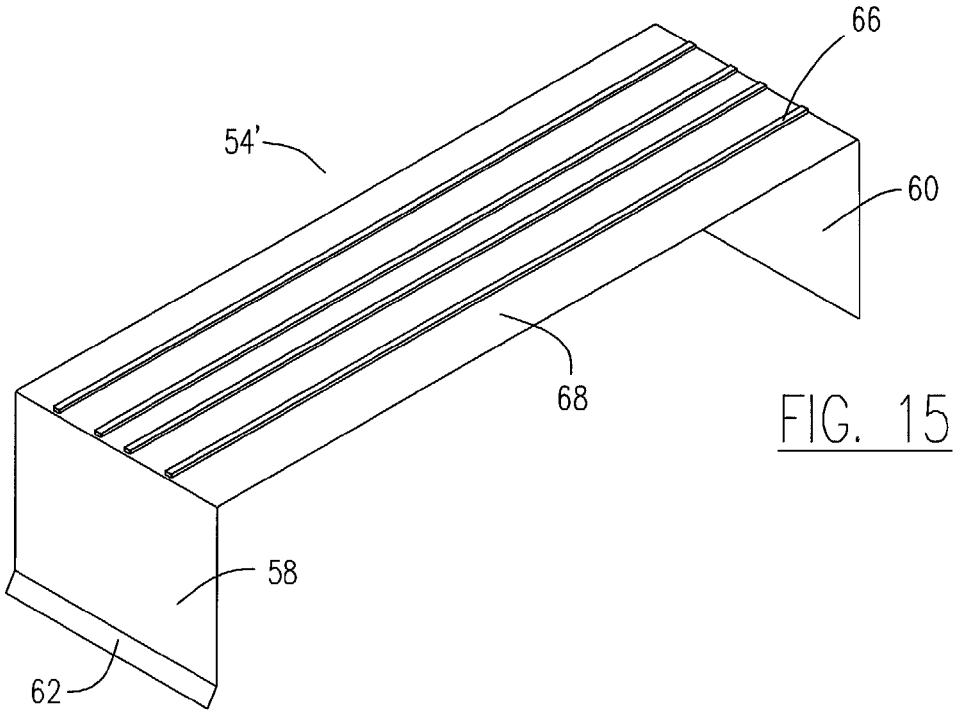
FIG. 15 is a perspective view of a splice channel for a wide parapet wall of a second embodiment of a parapet cover system in accordance with the present invention.
Figure 16:
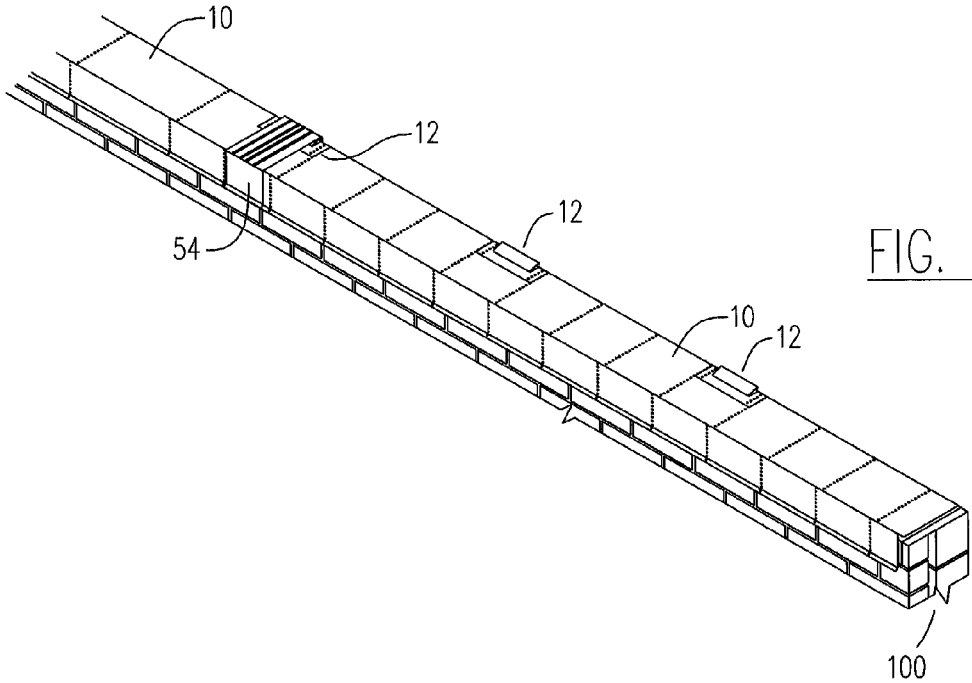
FIG. 16 is a perspective view of a splice channel attached over a spring support clip and a junction of a first and second clip support channel of a parapet cover system in accordance with the present invention.
Figure 17:
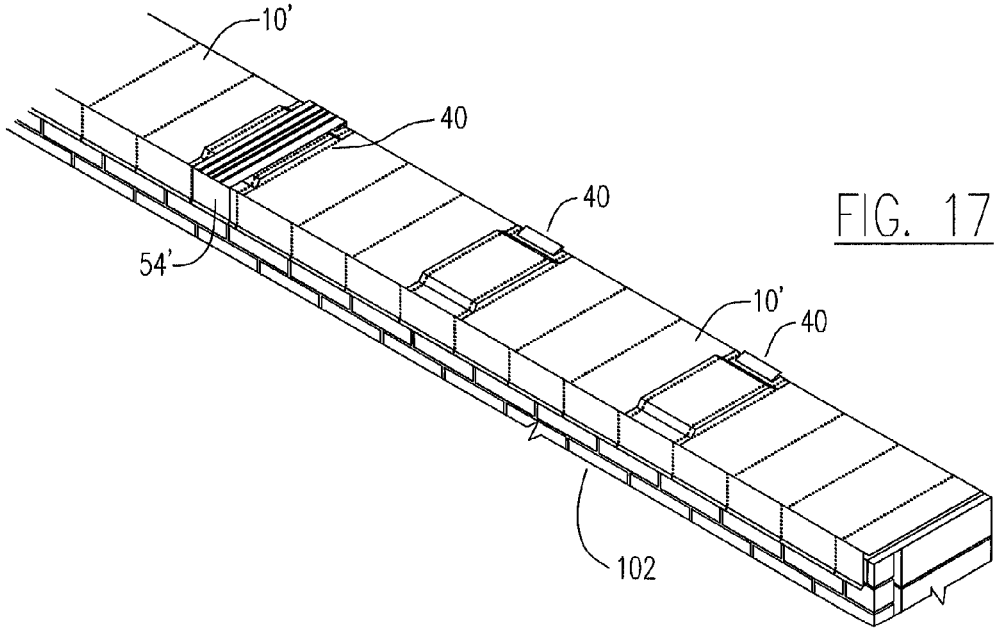
FIG. 17 is a perspective view of a splice channel attached over a spring support clip and a junction of a first and second clip support channel for a wide parapet wall of a second embodiment of a parapet cover system in accordance with the present invention.
Figure 18:
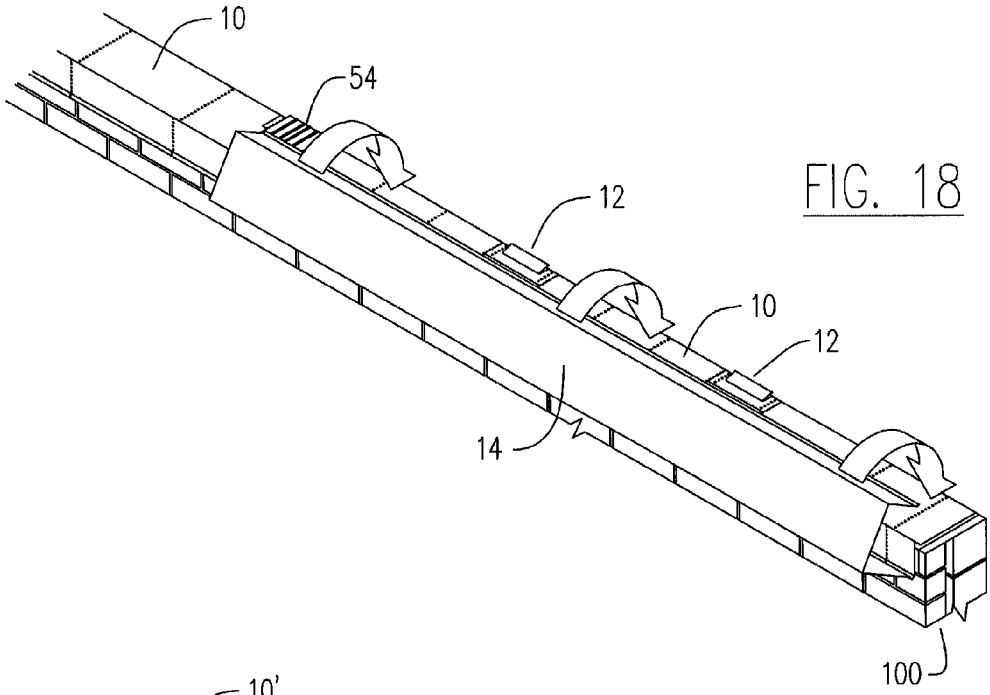
FIG. 18 is a perspective view of a cover channel being attached over a first clip support channel of a parapet cover system in accordance with the present invention.
Figure 19:
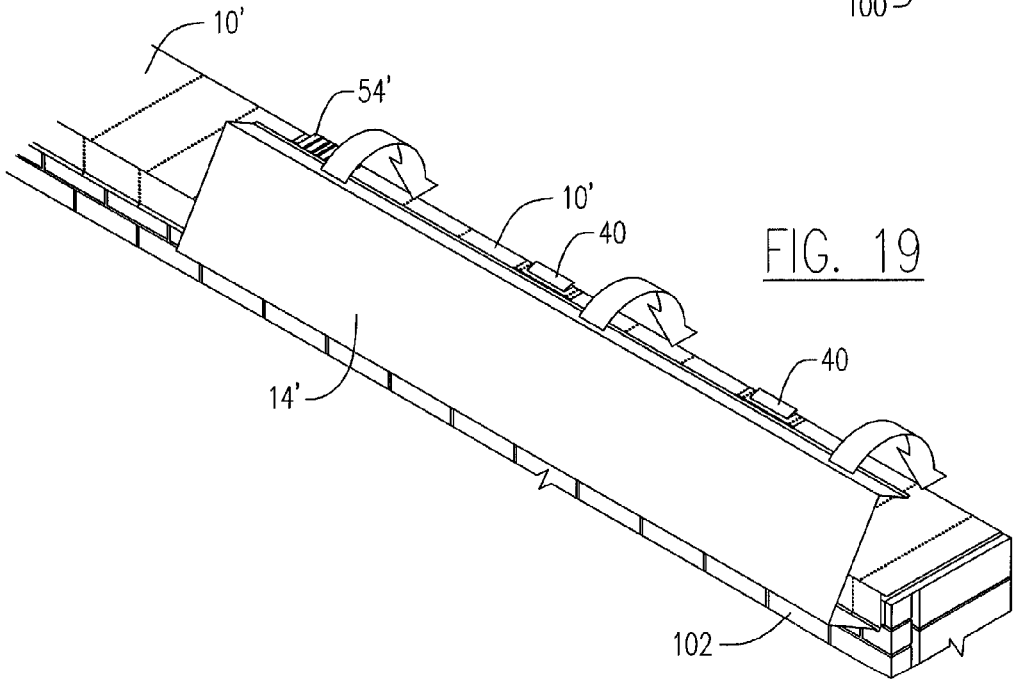
FIG. 19 is a perspective view of a cover channel being attached over a first clip support channel for a wide parapet wall of a second embodiment of a parapet cover system in accordance with the present invention.
Figure 20:
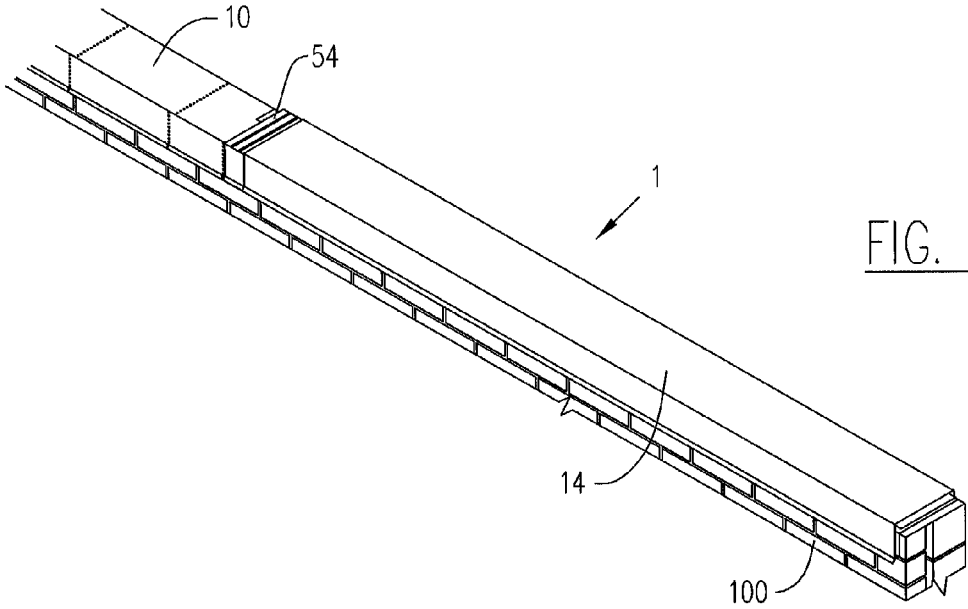
FIG. 20 is a perspective view of a cover channel secured to a first clip support channel of a parapet cover system in accordance with the present invention.
Figure 21:
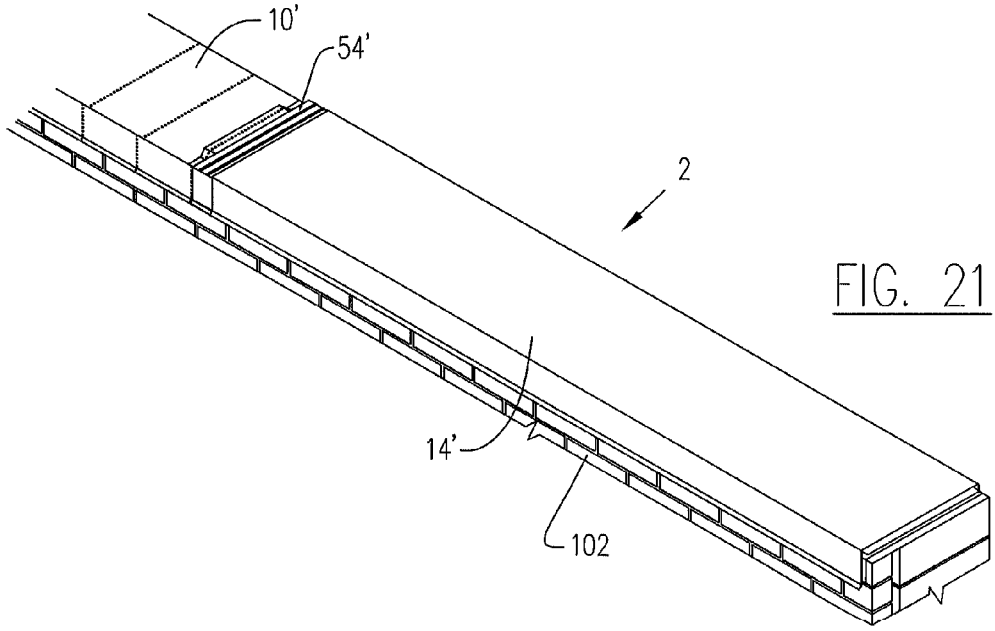
FIG. 21 is a perspective view of a cover channel secured to a first clip support channel for a wide parapet wall of a second embodiment of a parapet cover system in accordance with the present invention.

With reference to FIG. 14, a splice channel 54 includes a top surface 56, a first side surface 58 and a second side surface 60. The first side surface 58 extends downward from one end of the top surface 56 and the second side surface 60 extends downward from the other end of the top surface 56. At least two rows of butyl sealant 66 are applied to the top surface 56. The butyl sealant 66 seals two adjacent cover channels 14. With reference to FIG. 15, a splice channel 54' includes a top surface 68, the first side surface 58 and the second side surface 60. The difference between the splice channel 54 and the splice channel 54' is that the top surface 68 is longer than the top surface 56 to accommodate the wide parapet wall 102. FIG. 16 illustrates the splice channel 54 placed over the third spring support clip 12. FIG. 17 illustrates the splice channel 54' placed over the third spring support clip 40.

The cover channel 14 includes a top surface 70, a first side surface 72 and a second side surface 74. The first side surface 72 extends downward from one end of the top surface 70 and the second side surface 74 extends downward from the other end of the top surface 70. A bottom end of the first side surface 72 is terminated with a first attachment clip 76. The first attachment clip 76 is sized to receive and retain the first offset flange 24 and an end of the first side surface 58. A bottom end of the second side member 74 is terminated with a second attachment clip 78. The second attachment clip 78 is sized to receive and retain the second offset flange 26 and an end of the second side surface 60. The cover channel 14' includes a top surface 80, the first side surface 72 and the second side surface 74. The difference between the cover channel 14 and the cover channel 14' is that the top surface 80 is longer than the top surface 70 to accommodate the wide parapet wall 102.

With reference to FIGS. 18-21, the first attachment clip 76 of the cover channels 14, 14' is hooked over the first offset flange 24 and the end of the first side surface 58. The cover channels 14, 14' are rotated about the first offset flange 24 and the end of the first side surface 58 and pushed over the second offset flange 26, and the end of the second side surface 60 and hooked thereto. The first spring support 30 and the second spring support 31 support the top surface 70 of the cover channel 14. The first spring support 30, and the second spring support 31 and the offset portion 52 support the top surface 80 of the cover channel 14'.

With reference to FIG. 22*a*, air flows up through the parapet gap 101, the clip support channel 11 and down the first and second sides of the cover channel 14. With reference to FIG. 23*a*, air flows up through the parapet gap 103, the clip support channel 11' and down the first and second sides of the cover channel 14'.

Figure 24:
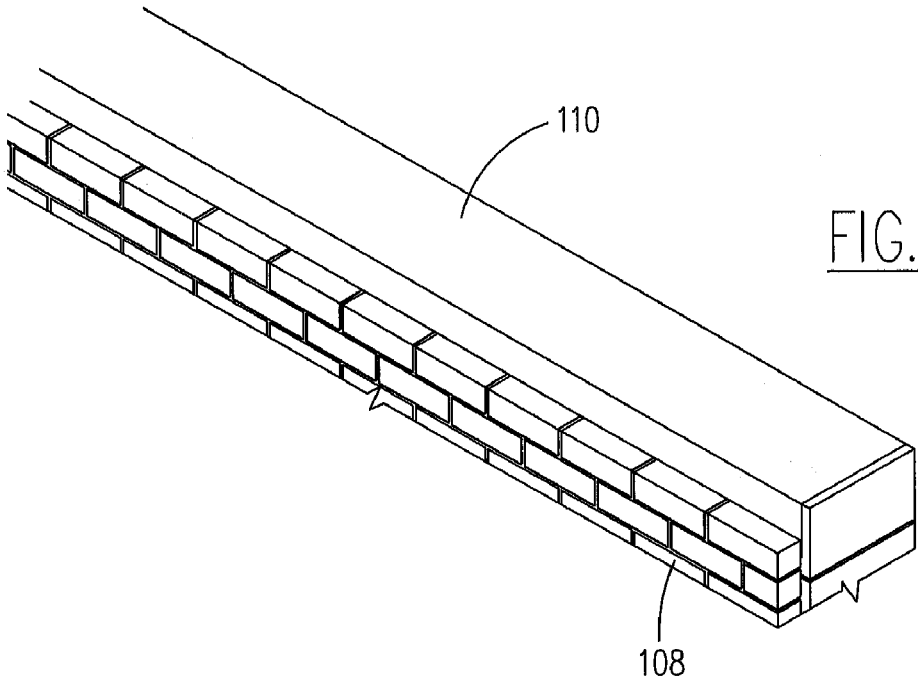
FIG. 24 is a perspective view of a parapet wall with a roof membrane laid partially thereover.
Figure 25:
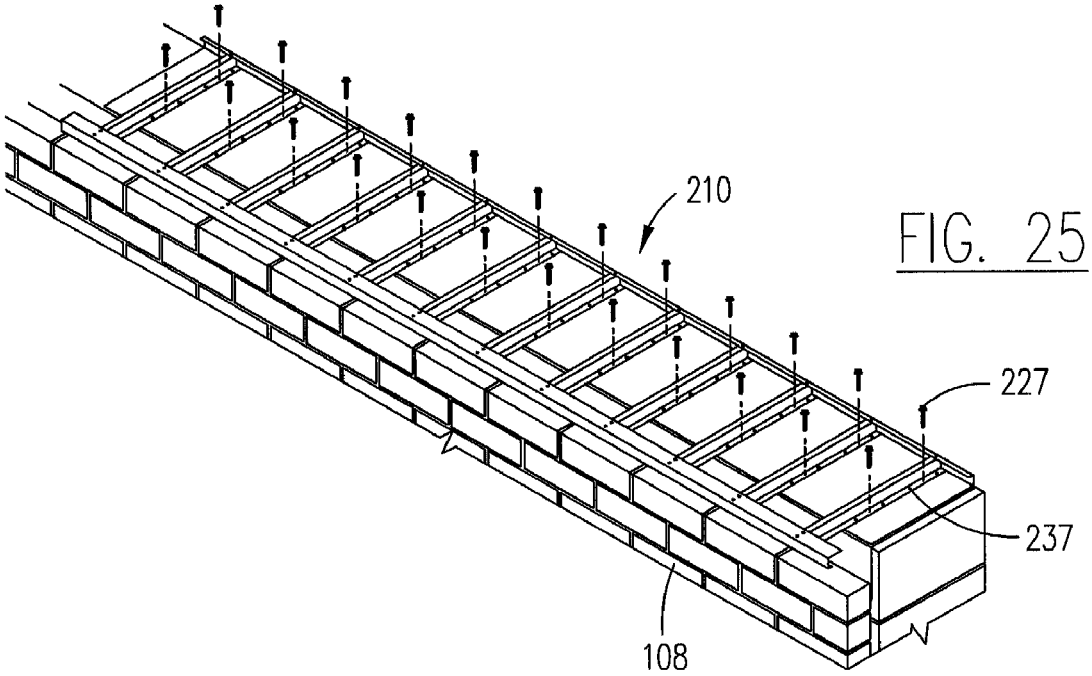
FIG. 25 is a perspective view of a parapet wall with a clip support structure before attachment thereto of a third embodiment of a vented parapet wall cover system in accordance with the present invention.
Figure 26:
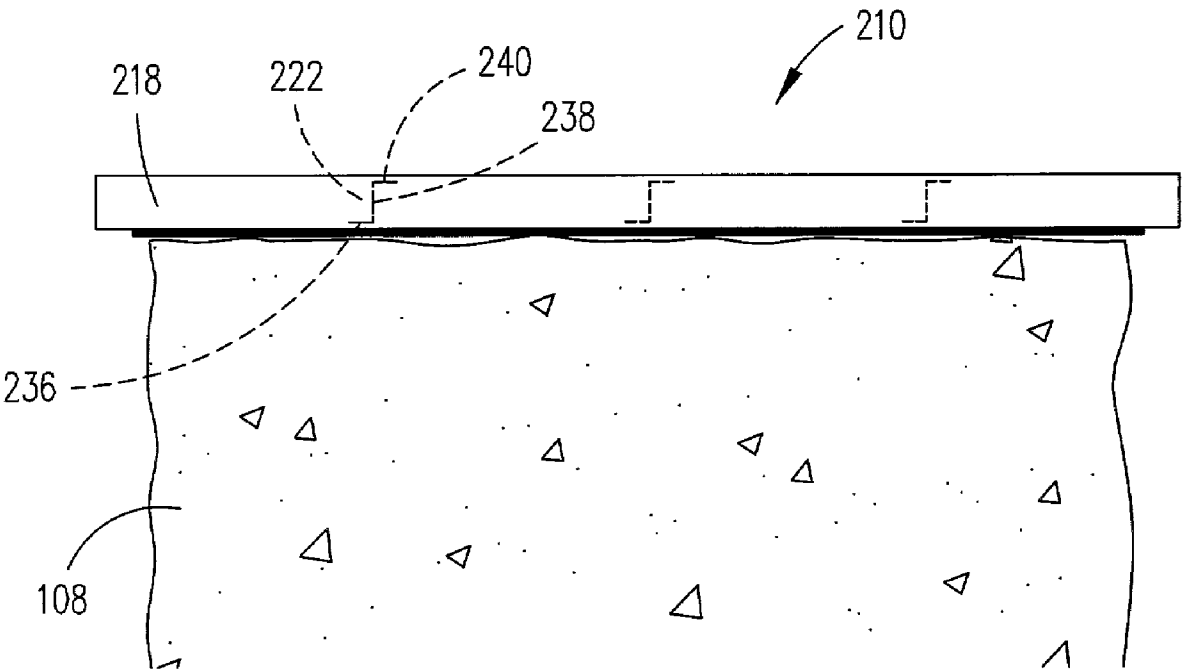
FIG. 26 is a front view of a clip support structure attached to a parapet wall of a third embodiment of a vented parapet wall cover system in accordance with the present invention.
Figure 37:
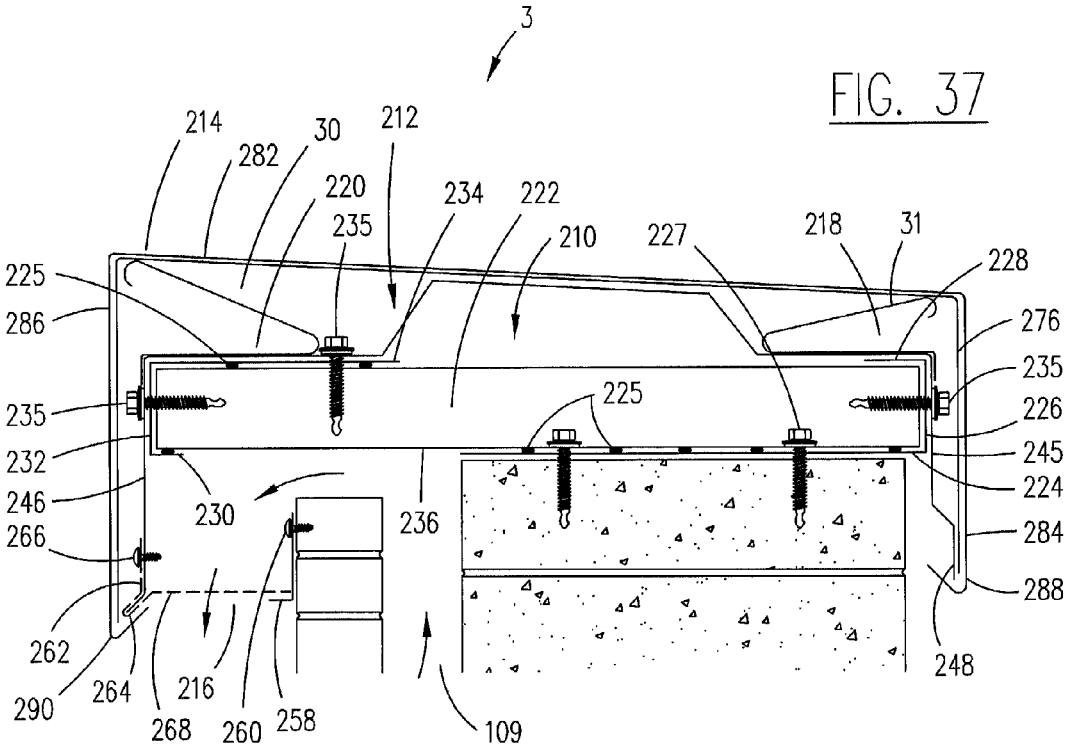
FIG. 37 is an end view of a third embodiment of a vented parapet cover system in accordance with the present invention.

FIG. 37 illustrates an end view of a third embodiment of a vented parapet cover system 3 for a parapet wall 108. FIG. 24 shows a roof membrane 110 placed over a top of the parapet wall 108. With reference to FIGS. 25-26, the vented parapet cover system 3 includes a clip support structure 210, at least one spring support clip 212, a cover channel 214 and a perforated closure 216. The clip support structure 210 includes a bottom channel 218, a top channel 220 and a plurality of support spacers 222. The bottom channel 218 includes a bottom attachment flange 224, a side attachment flange 226 and a top retention flange 228. The bottom attachment flange 224 extends from a bottom of the side attachment flange 226 and the top retention flange 228 extends from a top of the side attachment flange 226.

The top channel 220 includes a bottom retention flange 230, a side attachment flange 232 and a top attachment flange 234. The bottom retention flange 230 extends from a bottom of the side attachment flange 232 and the top attachment flange 234 extends from a top of the side attachment flange 232. One end of the plurality of support spacers 222 are inserted into the top channel 220 and secured thereto with any suitable attachment. The other end of the plurality of support spacers 222 are inserted into the bottom channel 218 and secured thereto with any suitable attachment process. The attachment of the top and bottom channels to the plurality of support spacers 222 preferably occurs at attachment areas 225 with any suitable method, such as a metal lock.

Each support spacer 222 includes a bottom flange 236, a base member 238 and a top flange 240. The bottom flange 236 extends from a bottom of the base member 238 and the top flange 240 extends from a top of the base member 238. A plurality of fastener holes 237 are formed through the bottom flange 236. A preferable length of the clip support structure 210 is at least four feet or long enough to provide a flat surface for the attachment of the cover channel 214 to the parapet wall 100. The clip structure 210 is preferably attached to the parapet wall 108 with a plurality of fasteners 227 inserted through the plurality of fastener holes 237 in a vertical plane and securing the plurality of fasteners 227 to the parapet wall 108.

Figure 27:
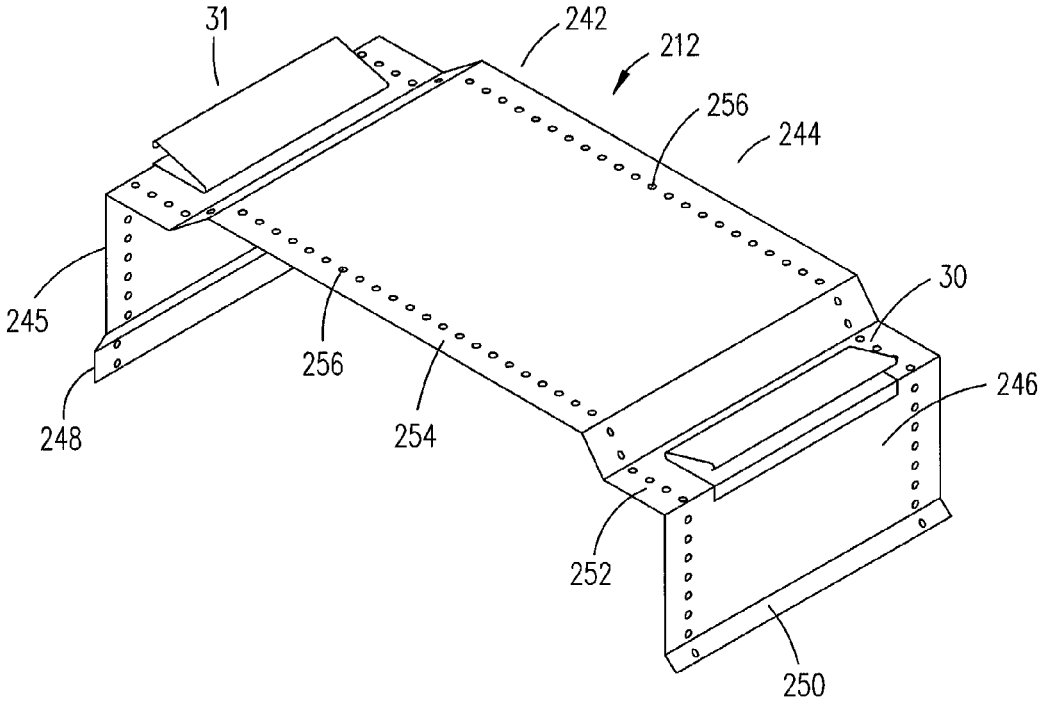
FIG. 27 is a perspective view of a spring support clip of a third embodiment of a vented parapet cover system in accordance with the present invention.
Figure 28:
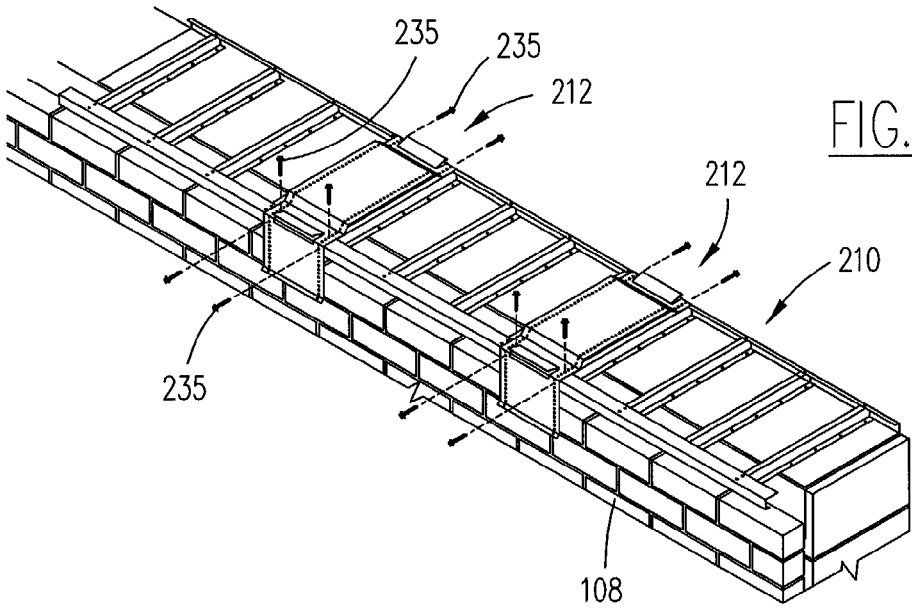
FIG. 28 is a perspective view of two spring support clips, before attachment to a clip support structure and a parapet wall of a third embodiment of a vented parapet cover system in accordance with the present invention.

With reference to FIG. 27, the spring support clip 212 includes a clip member 242, the first spring support 30 and the second spring support 31. The clip member 242 includes a base plate 244, a first side member 245 and a second side member 246. The first side member 245 extends downward from one end of the base plate 244 and the second side member 246 extends downward from the other end of the base plate 244. A bottom end of the first side member 245 is terminated with an offset flange 248. A bottom end of the second side member 246 is terminated with an angled flange 250. The base plate 244 includes a base portion 252 and an offset portion 254. The offset portion 254 extends upward from the base portion 252. The offset portion 254 supports the cover channel 214.

A distance between inner walls of the first and second side members are sized to receive an outer width of the clip support structure 210. A plurality of fastener holes 256 are formed through opposing sides of the base plate 244, the first side member 245 and the second side member 246. The spring base 34 of the first and second spring supports are attached to a top of the base portion 252 on each end with welding or any other suitable process. The locator leg 38 is used to located against the first or second side members. The at least one spring support clip 212 is attached to the parapet wall 108 with a plurality of fasteners 235.

Figure 29:
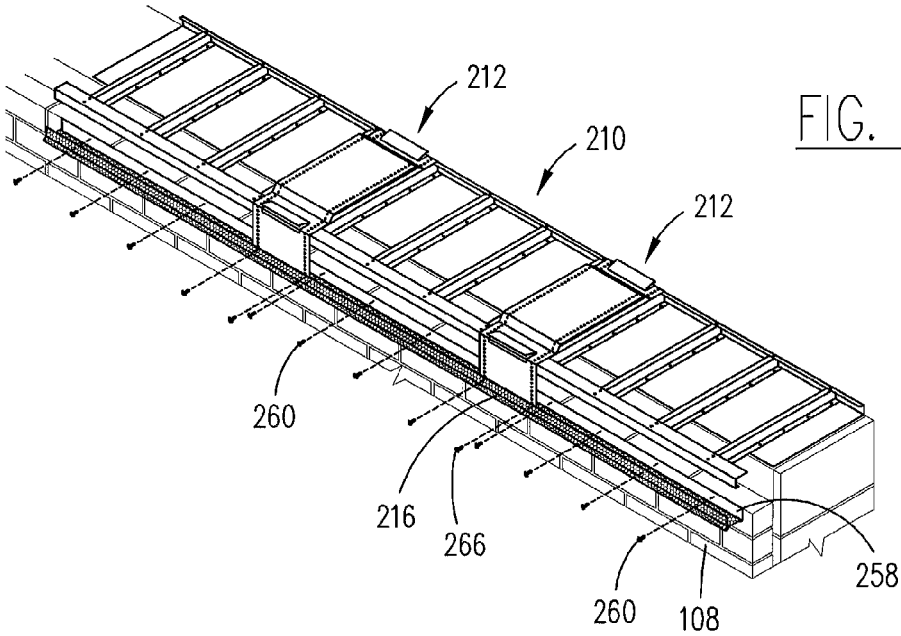
FIG. 29 is a perspective view of an L-bracket, before attachment to a parapet wall and a perforated closure, before attachment to two spring support clips of a third embodiment of a vented parapet cover system in accordance with the present invention.

With reference to FIG. 29, an L-trim bracket 258 is attached to a side of the parapet wall 108 with a plurality of fasteners 260. The perforated closure 216 includes a fastening flange 262, a flange retainer 264 and a closure member 268. The fastening flange 262 extends upward from one side of the angled flange retainer 264 and one end of the closure member 268 extends from the other side of the angled flange retainer 264. The angled flange retainer 264 is sized to receive the angled flange 250. The fastening flange 262 is attached to the second side members 246 with a plurality of fasteners 266. The L-trim bracket 258 retains the other end of the closure member 268 in the event it sags downward.

Figure 30:
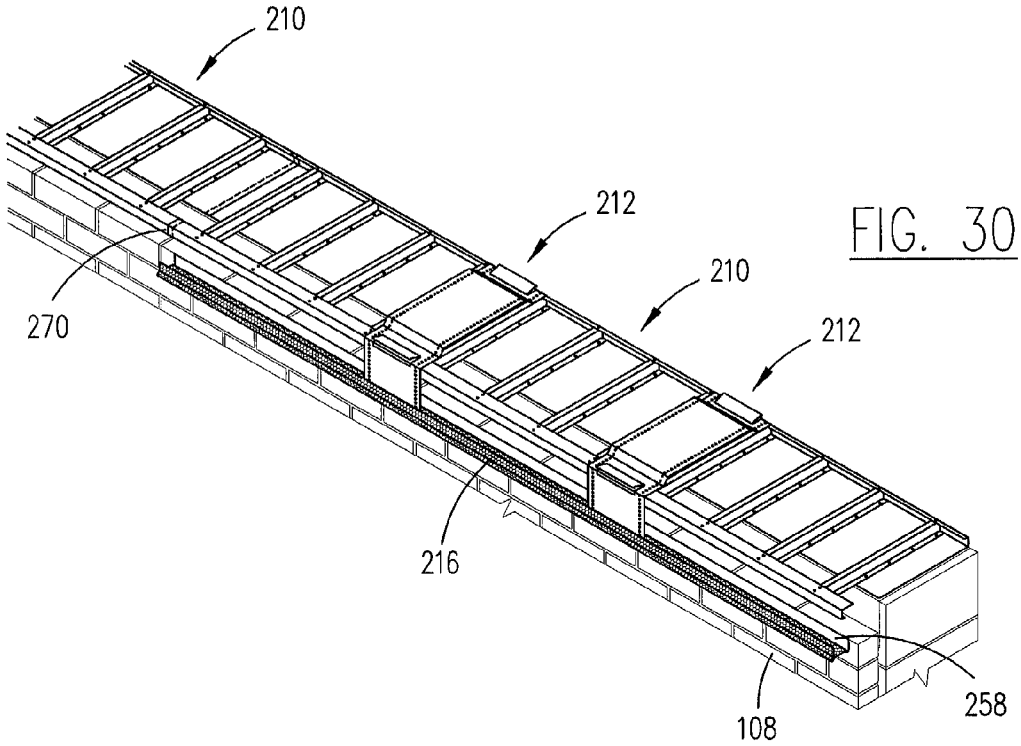
FIG. 30 is a perspective view of a second clip support structure overlapping a first clip support structure of a third embodiment of a vented parapet cover system in accordance with the present invention.
Figure 31:
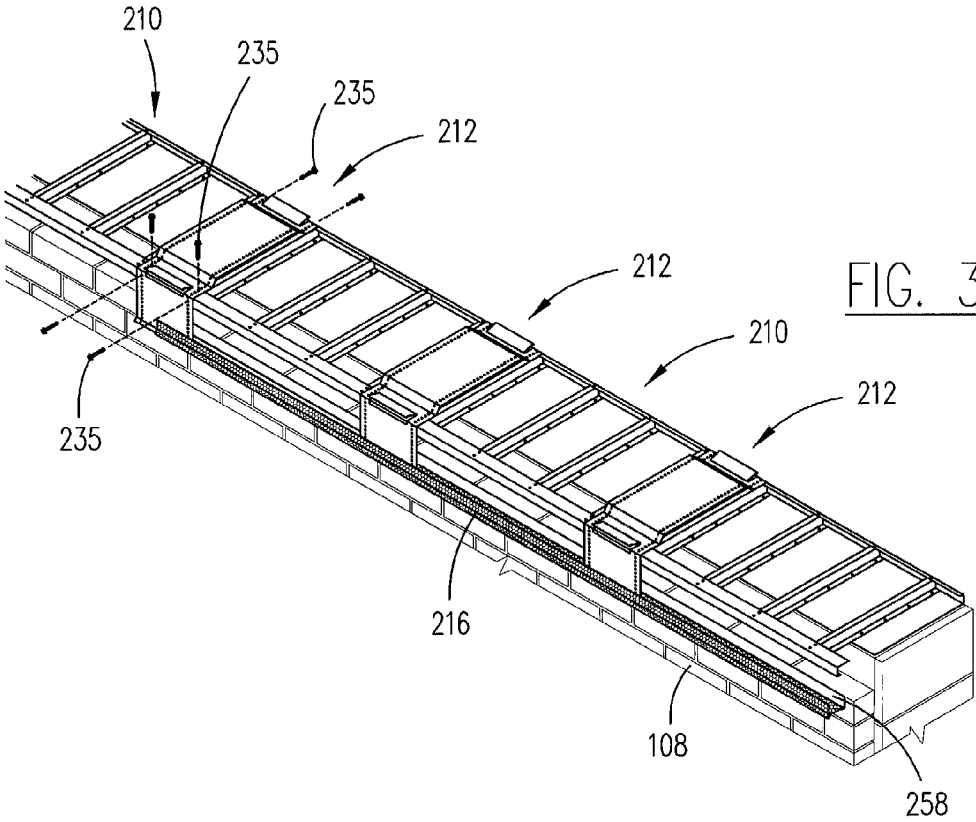
FIG. 31 is a perspective view of a spring support clip attached over a junction of first and second clip support structures of a third embodiment of a vented parapet cover system in accordance with the present invention.
Figure 32:
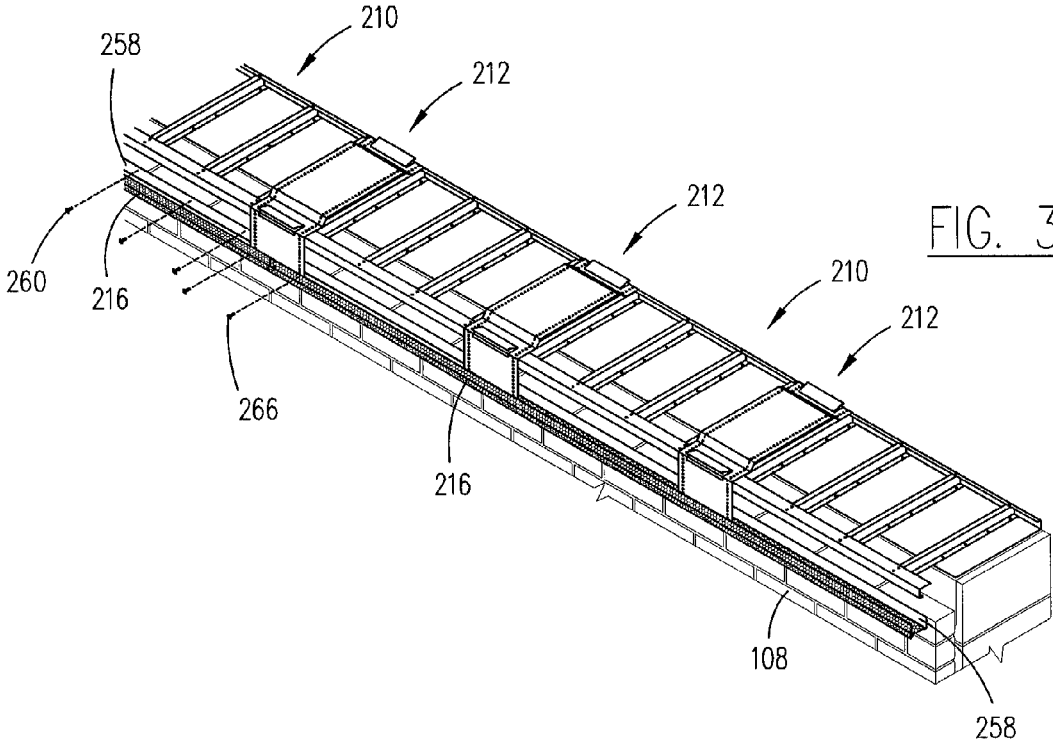
FIG. 32 is a perspective view of a second L-bracket overlapping a first L-bracket, before attachment to a parapet wall and a second perforated closure overlapping a first perforated closure, before attachment to a spring support clip of a third embodiment of a vented parapet cover system in accordance with the present invention.

With reference to FIG. 30, a second clip support structure 210 is attached to the parapet wall 108. A portion of the second clip support 210 preferably overlaps the first clip support structure 210 at an overlap area 270. With reference to FIG. 31, a third spring support clip 212 is fastened over the junction of the first and second clip support structures 210. With reference to FIG. 32, a second perforated closure 216 overlaps a first perforated closure 216 and a second L-trim bracket 258 overlaps a first L-trim bracket 258. The second perforated closure 216 is attached to the second side member 246 with at least two fasteners 266. The second L-trim bracket 258 is attached to the parapet wall 108 with a plurality of fasteners 260.

Figure 33:
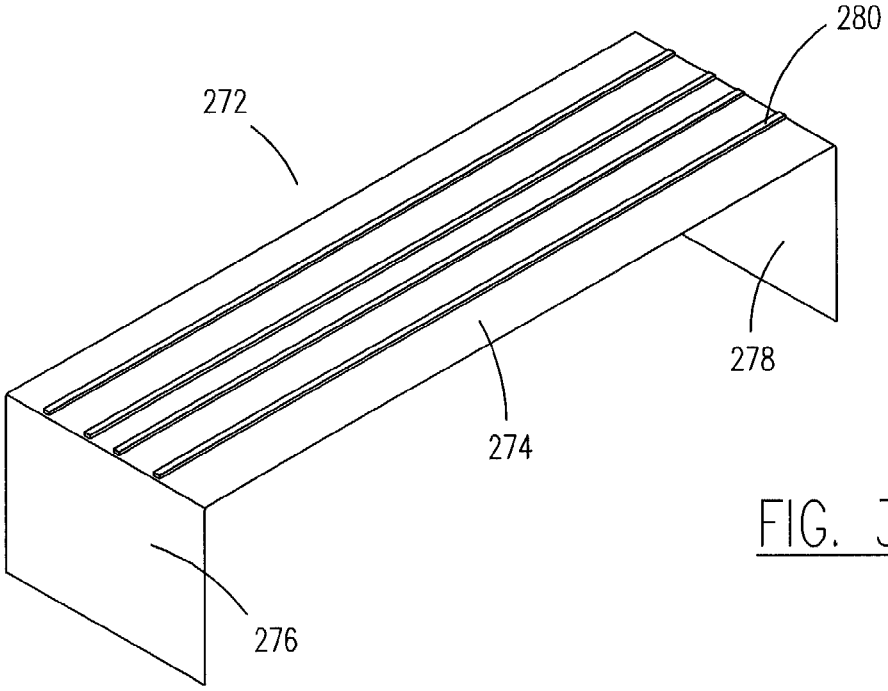
FIG. 33 is a perspective view of a splice channel for a parapet wall of a third embodiment of a vented parapet cover system in accordance with the present invention.
Figure 34:
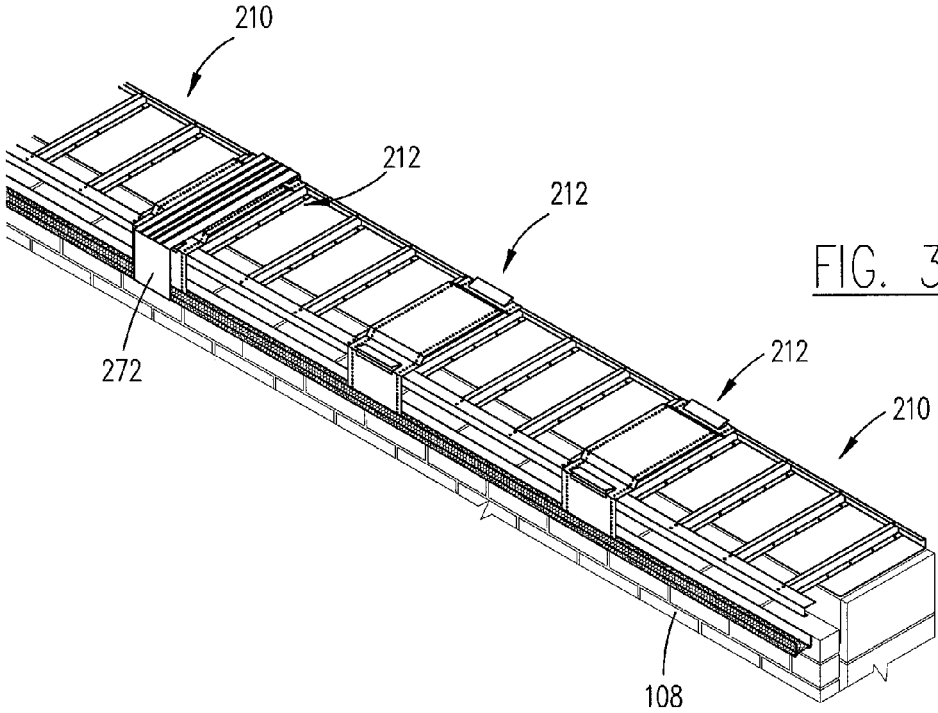
FIG. 34 is a perspective view of a splice channel attached over a spring support clip and a junction of a first and second clip support structure of a third embodiment of a vented parapet cover system in accordance with the present invention.

With reference to FIG. 33, a splice channel 272 includes a top surface 274, a first side surface 276 and a second side surface 278. The first side surface 276 extends downward from one end of the top surface 274 and the second side surface 278 extends downward from the other end of the top surface 274. At least two rows of butyl sealant 280 are applied to the top surface 274. The butyl sealant 280 seals two adjacent cover channels 214. With reference to FIG. 34, the splice channel 272 is placed over the third spring support clip 212.

The cover channel 214 includes a top surface 282, a first side surface 284 and a second side surface 286. The first side surface 282 extends downward from one end of the top surface 282 and the second side surface 284 extends downward from the other end of the top surface 282. A bottom end of the first side surface 284 is terminated with a first attachment clip 288. The first attachment clip 288 is sized to receive and retain the offset flange 248 and an end of the first side surface 276. A bottom end of the second side member 286 is terminated with a second attachment clip 290. The second attachment clip 290 is sized to receive and retain the angled flange retainer 264 and an end of the second side surface 278.

Figure 35:
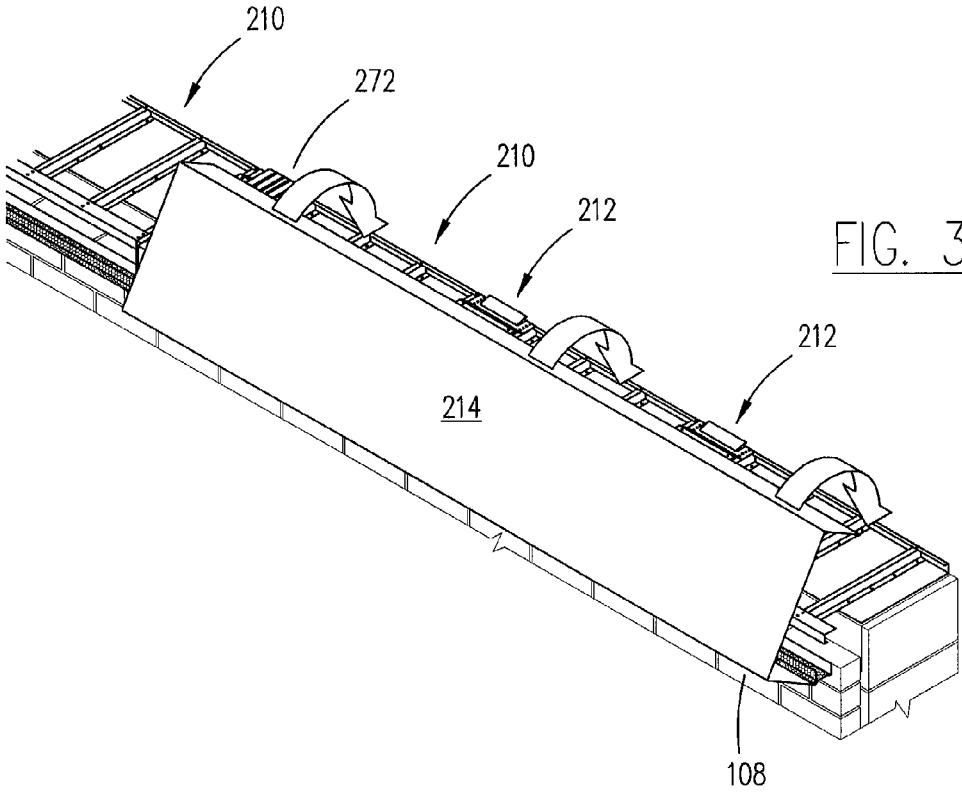
FIG. 35 is a perspective view of a cover channel being attached over two spring support clips for a third embodiment of a vented parapet cover system in accordance with the present invention.
Figure 36:
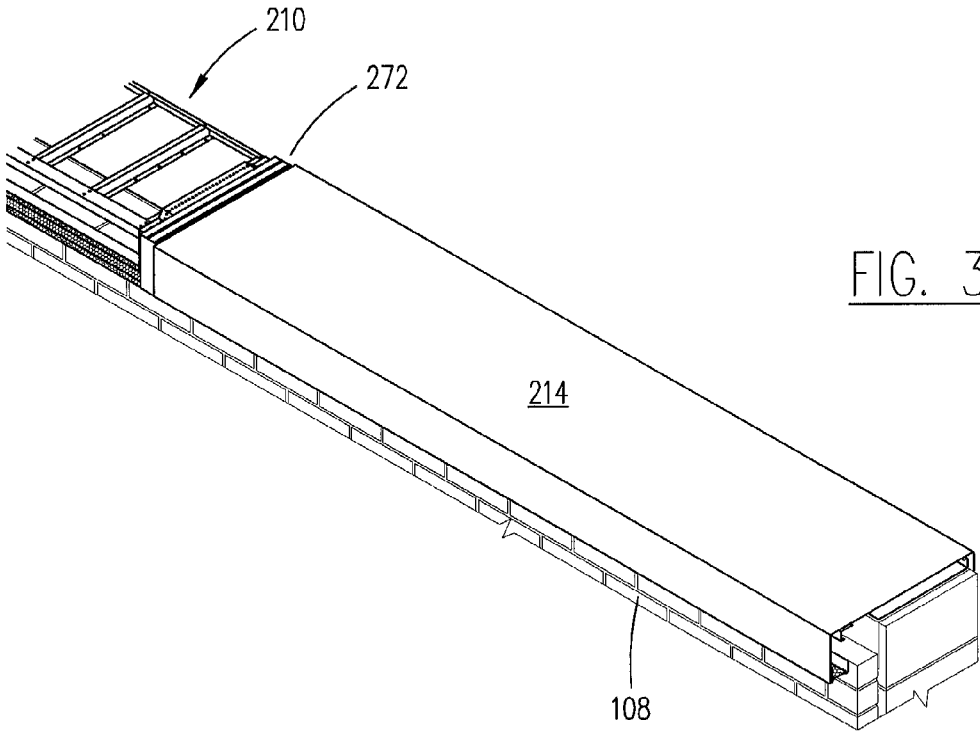
FIG. 36 is a perspective view of a cover channel secured to two spring support clips for a second embodiment of a parapet cover system in accordance with the present invention.

With reference to FIGS. 35-36, the second attachment clip 290 of the cover channel 214 is hooked over the angled flange retainer 264 and the end of the second side surface 278. The cover channel 214 is rotated about the angled flange retainer 264 and the end of the second side surface 278 and pushed over the first offset flange 248 and an end of the first side surface 276. The first spring support 30 and the second spring support 31 support the top surface 282 of the cover channel 214. Air flows up through a parapet gap 109 and down through the closure member 268.

The parapet walls 100, 102, 108 are shown as being constructed from brick or block. However, the parapet walls 100, 102, 108 should not be limited to construction of brick or block, but should include any suitable building materials.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A parapet cover system comprising:

a bottom channel including a bottom attachment flange, said bottom attachment flange is attached to a parapet;

a top channel including a top attachment flange;

a plurality of support spacers, each one of said plurality of support spacers having a base member, a bottom flange and a top flange, said top flange extends from a top of said base member, said bottom flange extends from a bottom of said base member, said bottom attachment flange is attached to said bottom flange with at least one first fastener, said top attachment flange is attached to said top flange with at least one second fastener;

at least one spring support clip for securement to at least said bottom and top channels; and a cover channel including a top surface, a first side surface and a second side surface, said first and second side surfaces being securable to said at least one spring support clip.

2. The parapet cover system of claim 1, further comprising:

each one of said at least one spring support clip including a base plate, a first side member and a second side member, said first side surface being securable to said first side member, said second side surface being securable to said second side member.

3. The parapet cover system of claim 2, further comprising:

a perforated closure being attached to one of said first side member and said second side member.

4. The parapet cover system of claim 1, further comprising:

each one of said at least one spring support clip including a base plate, a first spring support being disposed on one end of said base plate, a second spring support being disposed on the other end of said base plate, said first and second spring supports pivoting relative to said base plate.

5. The parapet cover system of claim 1, further comprising:

said bottom attachment flange having a length that is long enough to provide a flat surface for retention of said cover channel.

6. The parapet cover system of claim 1, further comprising:

said bottom channel including a top flange, a first side flange and said bottom attachment flange; and said top channel including a bottom flange, a second side flange and said top attachment flange.

7. A parapet cover system comprising:

a bottom channel including a bottom attachment flange and a top retention flange, said bottom attachment flange is attached to a parapet wall;

a top channel including a top attachment flange and a bottom retention flange;

a plurality of support spacers, each one of said plurality of support spacers having a base member, a bottom flange and a top flange, said top flange extends from a top of said base member, said bottom flange extends from a bottom of said base member, one end of said plurality of support spacers are inserted between said top attachment flange and said bottom retention flange, the other end of said plurality of spacers are inserted between said bottom attachment flange and said top retention flange, said bottom attachment flange is attached to said bottom flange with at least one first fastener, said top attachment flange is attached to said top flange with at least one second fastener;

a plurality of support spacers, each one of said plurality of support spacers having a bottom flange and a top flange, said bottom attachment flange is attached to said bottom flange, said top attachment flange is attached to said top flange;

at least one spring support clip for securement to at least one of said top and bottom channels, each one of said at least one spring support clip including a first side member and a second side member; and a cover channel including a top surface, a first side surface and a second side surface, said cover channel is placed over said at least one spring support clip.

8. The parapet cover system of claim 7, further comprising:

a first flange being formed on a bottom of said first side member, a second flange being formed on a bottom of said second side member, a first clip being formed on a bottom of said first side surface, said first clip retaining said first flange, a second clip being formed on a bottom of said second side surface, said second clip retaining said second flange.

9. The parapet cover system of claim 7, further comprising:

each one of said at least one spring support clip including a base plate, a first spring support being disposed on one end of said base plate, a second spring support being disposed on the other end of said base plate, said first and second spring supports pivoting relative to said base plate.

10. The parapet cover system of claim 7, further comprising:

said bottom attachment flange having a length that is long enough to provide a flat surface for retention of said cover channel.

11. A parapet cover system comprising:

a bottom channel including a bottom attachment flange, said bottom attachment flange is attached to a parapet;

a top channel including a top attachment flange;

a plurality of support spacers, each one of said plurality of support spacers having a base member, a bottom flange and a top flange, said top flange extends substantially perpendicular from a top of said base member, said bottom flange extends substantially perpendicular from a bottom of said base member, said top flange and said bottom flange are substantially parallel to each other, said bottom attachment flange is attached to said bottom flange with at least one first fastener, said top attachment flange is attached to said top flange with at least one second fastener;

at least one spring support clip for securement to at least said bottom and top channels; and a cover channel including a top surface, a first side surface and a second side surface, said first and second side surfaces being securable to said at least one spring support clip.

12. The parapet cover system of claim 11, further comprising:

each one of said at least one spring support clip including a base plate, a first side member and a second side member, said first side surface being securable to said first side member, said second side surface being securable to said second side member.

13. The parapet cover system of claim 11, further comprising:

each one of said at least one spring support clip including a base plate, a first spring support being disposed on one end of said base plate, a second spring support being disposed on the other end of said base plate, said first and second spring supports pivoting relative to said base plate.

14. The parapet cover system of claim 11, further comprising:

said bottom attachment flange having a length that is long enough to provide a flat surface for retention of said cover channel.

* * * * *